US007255808B2

(12) United States Patent
Silverman et al.

(10) Patent No.: US 7,255,808 B2
(45) Date of Patent: Aug. 14, 2007

(54) FUNCTIONAL FLUID COMPOSITIONS CONTAINING EROSION INHIBITORS

(75) Inventors: David C. Silverman, Chesterfield, MO (US); Timothy K. Hirzel, St. Louis, MO (US)

(73) Assignee: Solutia, Inc., St. Louis, MO (US)

( * ) Notice: Subject to any disclaimer, the term of this patent is extended or adjusted under 35 U.S.C. 154(b) by 638 days.

(21) Appl. No.: 10/700,395

(22) Filed: Nov. 4, 2003

(65) Prior Publication Data

US 2005/0056809 A1 Mar. 17, 2005

Related U.S. Application Data

(60) Provisional application No. 60/423,564, filed on Nov. 4, 2002.

(51) Int. Cl.
*C09K 5/00* (2006.01)
*C10M 105/74* (2006.01)

(52) U.S. Cl. ..... 252/78.5; 252/74; 252/75; 252/76

(58) Field of Classification Search ..... 252/78.5
See application file for complete search history.

(56) References Cited

U.S. PATENT DOCUMENTS 4,252,662 A * 2/1981 Marolewski et al. ..... 252/78.5
4,302,346 A * 11/1981 MacKinnon ..... 252/75
4,324,674 A * 4/1982 MacKinnon ..... 252/78.5
4,370,254 A 1/1983 Mitschke et al.
4,387,222 A 6/1983 Koshar
5,035,824 A * 7/1991 MacKinnon ..... 252/75
5,205,951 A * 4/1993 MacKinnon ..... 252/78.5
5,464,551 A * 11/1995 Deetman ..... 252/78.5
6,254,799 B1 * 7/2001 Antika et al. ..... 252/78.5
6,319,423 B1 * 11/2001 Okazaki et al. ..... 252/78.5
6,391,225 B1 * 5/2002 Poirier ..... 252/78.5
6,555,510 B2 * 4/2003 Lamanna et al. ..... 510/175
6,599,866 B2 * 7/2003 Poirier ..... 508/406
6,649,080 B2 * 11/2003 Okazaki et al. ..... 252/78.5
6,652,772 B2 * 11/2003 Antika et al. ..... 252/78.5
6,703,355 B2 * 3/2004 Antika et al. ..... 508/433
6,764,610 B2 * 7/2004 Poirier ..... 252/73
6,764,611 B2 * 7/2004 Poirier ..... 252/73
7,018,559 B2 * 3/2006 Zhang et al. ..... 252/73
7,030,067 B2 * 4/2006 Lamanna et al. ..... 508/568

FOREIGN PATENT DOCUMENTS

EP 1 344 772 A1 9/2003
WO PCT/US95/15984 6/1996

* cited by examiner

*Primary Examiner*—Ellen M. McAvoy
(74) *Attorney, Agent, or Firm*—Blackwell Sanders Peper Martin, LLC

(57) ABSTRACT

A phosphate ester-based functional fluid composition incorporating at least one erosion inhibitor selected from the erosion inhibitors of the invention. The phosphate ester-based functional fluids are particularly useful as aviation hydraulic fluids.

96 Claims, No Drawings

FUNCTIONAL FLUID COMPOSITIONS CONTAINING EROSION INHIBITORS

RELATED APPLICATIONS

This application is a nonprovisional application of U.S. Pat. Ser. No. 60/423,564, filed Nov. 4, 2002, entitled "Functional Fluid Compositions Containing Erosion Inhibitors" the disclosure of which is incorporated herein by reference.

BACKGROUND OF THE INVENTION

This invention relates to improved functional fluid compositions containing erosion inhibitors. This invention further relates to phosphate ester-based functional fluids, particularly phosphate ester-based hydraulic fluids, containing the erosion inhibitors of this invention.

In the past, functional fluids have been utilized as electronic coolants, diffusion pump fluids, lubricants, damping fluids, bases for greases, power transmission and hydraulic fluids, heat transfer fluids, heat pump fluids, refrigeration equipment fluids, and as a filter medium for air-conditioning systems. Phosphate ester-based functional fluids have been recognized for some time as advantageous for use as the power transmission medium in hydraulic systems. Such systems include recoil mechanisms, fluid-drive power transmissions, and aircraft hydraulic systems. Hydraulic fluids intended for use in the hydraulic system of aircraft for operating various mechanisms and aircraft control systems must meet stringent functional and use requirements. Phosphate ester-based fluids find particular utility in aircraft hydraulic fluids because of their special properties which include high viscosity index, low pour point, high lubricity, low toxicity, low density and low flammability. Thus, for many years, numerous types of aircraft, particularly commercial jet aircraft, have used phosphate ester-based fluids in their hydraulic systems. Among the most important requirements of an aircraft hydraulic fluid is that it be stable against oxidative and hydrolytic degradation at elevated temperatures.

In addition, functional fluids for use in aircraft hydraulic systems must be capable of performing in the hydraulic system over an extended period of time without causing significant damage or functional impairment to the various conduits, valves, pumps, and the like, through which the functional fluid flows in the course of such use. Damage caused by functional fluids contacting valves and other members has been attributed to streaming current induced corrosion, hereinafter referred to as erosion, by the environment in contact with the functional fluid in a hydraulic system.

The hydraulic systems of a typical modem aircraft contain a fluid reservoir, fluid lines and numerous hydraulic valves which actuate various moving parts of the aircraft such as the wing flaps, ailerons, rudder and landing gear. In order to function as precise control mechanisms, these valves often contain passages or orifices having clearances on the order of a few thousandths of an inch or less through which the hydraulic fluid must pass. In a number of instances, valve orifices have been found to be substantially eroded by the flow of hydraulic fluid. Erosion increases the size of the passage and reduces below tolerable limits the ability of the valve to serve as a precision control device. For example, aircraft have experienced slow response of flight controls as a result of valve erosion. Thus, phosphate ester-based aircraft hydraulic fluids require use of an erosion inhibitor, i.e. a functional fluid additive which prevents or inhibits the erosion of hydraulic system valves. Other additives which perform special functions such as hydrolysis inhibition, viscosity index improvement and foam inhibition are also frequently present in such hydraulic fluid. For example, epoxides are utilized commonly in phosphate ester-based hydraulic fluids to stabilize the phosphate ester.

Current commercial phosphate ester-based aircraft hydraulic fluids such as Skydrol® LD-4 aviation hydraulic fluid and Skydrol® 5 aviation hydraulic fluid, both available from Solutia Inc., successfully utilize alkali metal salts of perfluoroalkyl sulfonic acids, e.g. Fluorad™ FC-98 of 3M Company, as erosion inhibitors. It would be desirable to have alternative erosion inhibitors available for use in phosphate ester-based aircraft hydraulic fluids. New erosion inhibitors for use in phosphate ester-based aircraft hydraulic fluids have now been discovered.

SUMMARY OF THE INVENTION

According to the invention, functional fluid compositions are provided comprising (a) a basestock comprising a phosphate ester, and (b) an effective erosion inhibiting amount of at least one erosion inhibitor of the present invention, wherein the effective amount of the erosion inhibitor(s) used in the functional fluid compositions of the invention is substantially soluble in the functional fluid compositions of the invention, and the erosion inhibitor(s) used in the functional fluid compositions of the invention at least partially ionize.

BRIEF DESCRIPTION OF THE DRAWINGS

Not Applicable.

DETAILED DESCRIPTION OF THE INVENTION

A first embodiment of the invention relates to a functional fluid composition comprising: (a) a basestock comprising a phosphate ester, and (b) an effective erosion inhibiting amount of at least one erosion inhibitor selected from compounds represented by the formulas:

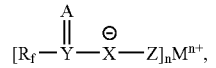

(I)

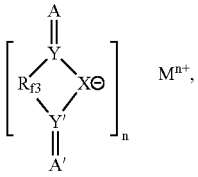

(II)

or mixtures thereof; wherein the erosion inhibitor(s) used in the functional fluid compositions of the invention at least partially ionize, and the effective amount of the erosion inhibitor(s) used in the functional fluid compositions of the invention is essentially soluble in the functional fluid compositions of the invention. $R_f$ is selected from fluoroalkyl, fluoroaryl, fluoroaralkyl, fluoroalkaryl, fluorocycloalkyl, fluoroalkoxyalkyl, or fluoropolyalkoxyalkyl groups; Y and Y' are independently selected from C, S, S(═A), P—$R_f$, P—OR, or P—NRR'; A and A' are independently selected from O or NR; X is selected from N, or C—R"; Z is selected from Y'(═A')—$R_f$, H, OC(═O)—$R_f$, or $R_1$—NH—($SO_2$—$R_f$); R and R' are independently selected from H, alkyl, fluoroalkyl, aryl, fluoroaryl, alkaryl, aralkyl, fluoroalkaryl, or fluoroaralkyl; R" is selected from H, alkyl, fluoroalkyl, aryl, fluoroaryl, alkaryl, aralkyl, fluoroalkaryl, fluoroaralkyl, or —Y(═A)$R_2$ (wherein when R" is —Y(═A)$R_2$, —Y(═A)$R_2$ is preferably—C(O)$R_2$ or —$SO_2$—$R_2$); $R_2$ is selected from alkyl, fluoroalkyl, aryl, fluoroaryl, alkaryl, aralkyl, fluoroalkaryl, or fluoroaralkyl; $R_1$ is selected from unsubstituted or fluoro-substituted alkylene, cycloalkylene, alkarylene, aralkylene, or arylene groups; and $R_{f3}$ is selected from fluoroalkylene, fluoroarylene, fluoroaralkylene, fluoroalkarylene, fluoroalkoxyalkylene, or fluoropolyalkoxyalkylene moieties. M is a cation of valence n; and n is 1, 2, 3 or 4. Z is preferably selected from Y'(═A')—$R_f$, OC(═O)—$R_f$, or $R_1$—NH—($SO_2$—$R_f$). When more than one $R_f$ is in formula (I), such as when two groups $R_{f1}$ and $R_{f2}$ are present, each $R_f$ is independently selected from fluoroalkyl, fluorocycloalkyl, fluoroaryl, fluoroalkaryl, fluoroaralkyl, fluoroalkoxyalkyl, or fluoropolyalkoxyalkyl groups. When variables are selected such that more than one of a particular variable, e.g. A, is present in a specific formula of general formulas (I) or (II), those variables are independently selected such that they can be the same or different based on the definition of that specific variable.

The "alkyl" group in the terms alkyl, fluoroalkyl, aralkyl, fluoroaralkyl, alkaryl, or fluoroalkaryl, as used herein, can be either straight-chain or branched carbon chains. The "alkylene" group in the terms fluoroalkylene, fluoroaralkylene, fluoroalkoxy-alkylene, or fluoropolyalkoxyalkylene, as used herein, can be either straight-chain or branched carbon chains. The term "aralkyl" is defined herein as an alkyl group which is substituted with an aryl group. The term "fluoroaralkyl" is defined herein as a fluoroalkyl group which is substituted with an aryl or a fluoroaryl group, or an alkyl group substituted with a fluoroaryl group. The term "alkaryl" is defined herein as an aryl group which is substituted with an alkyl group. The term "fluoroalkaryl" is defined herein as a fluoroaryl group which is substituted with an alkyl or fluoroalkyl group, or an aryl group substituted with a fluoroalkyl group. The term "fluoroaralkylene" is defined herein as a fluoroalkylene group which is substituted with an aryl or a fluoroaryl group, or an alkylene group substituted with a fluoroaryl group. The term "fluoroalkarylene" is defined herein as a fluoroarylene group which is substituted with an alkyl or a fluoroalkyl group, or an arylene group substituted with a fluoroalkyl group.

Examples of suitable anions of general formula (I) include, but are not limited to, anions represented by the following formulas:

Formulae (1)-(14) are specific formulae in which X is N.

(1)

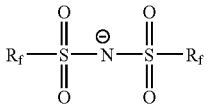

-continued (2)

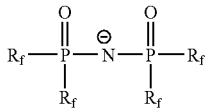

(3)

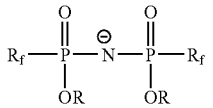

(4)

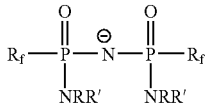

(5)

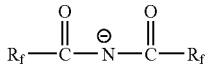

(6)

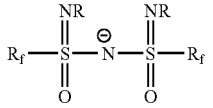

(7)

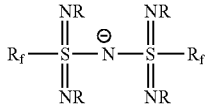

(8)

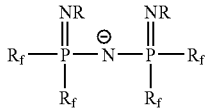

(9)

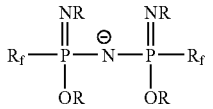

(10)

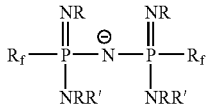

(11)

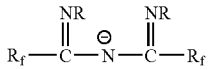

(12)

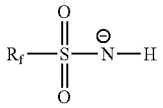

(13)

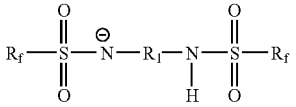

(14)

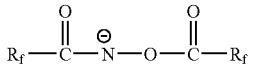

Formulae (15)-(23) are specific formulae in which X is C—R" wherein R" is —Y(═A)$R_2$.

(15)

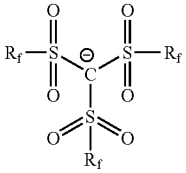

(16)

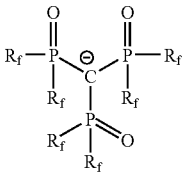

(17)

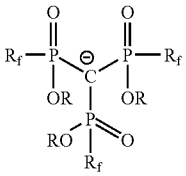

(18)

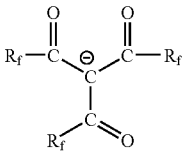

(19)

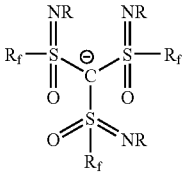

(20)

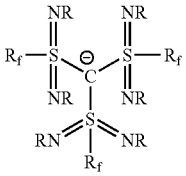

(21)

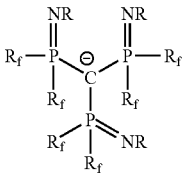

(22)

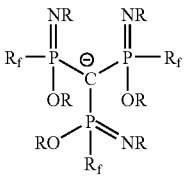

-continued (23)

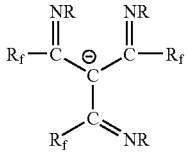

Formulae (24)-(26) are specific formulae in which X is C—R", wherein R" is H.

(24)

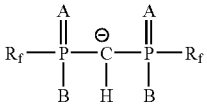

(25)

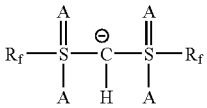

(26)

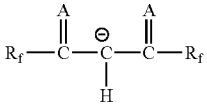

Formulae (27)-(29) are specific formulae in which X is C—R", wherein R" is selected from alkyl, fluoroalkyl, aryl, fluoroaryl, alkaryl, aralkyl, fluoroalkaryl, or fluoroaralkyl.

(27)

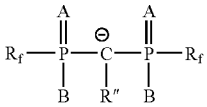

(28)

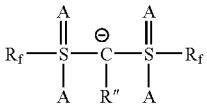

(29)

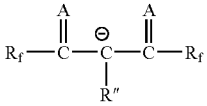

Formulae (30)-(33) are specific formulae in which Z=Y'(═A')$R_f$, wherein Y'(═A') is different from Y(═A).

(30)

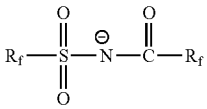

(31)

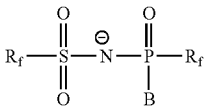

-continued (32)

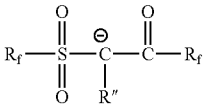

(33)

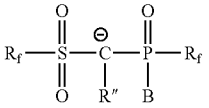

In formulae 24, 27, 31, and 33, the B groups are independently selected from OR and NRR'.

Formulae (34)-(36) are specific formulae in which Y is S, wherein the functional group is S(═O).

(34)

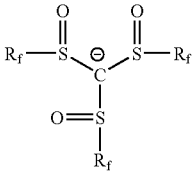

(35)

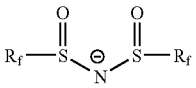

(36)

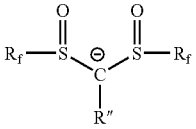

The variables of general formula (I) are as follows in formulae (1)-(36):

Formula (1): X is N, Y is S(═A), Z is Y(═A)$R_f$, A is O.

Formula (2): X is N, Y is P($R_f$), Z is Y(═A)$R_f$, A is O.

Formula (3): X is N, Y is P(OR), Z is Y(═A)$R_f$, A is O.

Formula (4): X is N, Y is P(NRR'), Z is Y(═A)$R_f$, A is O.

Formula (5): X is N, Y is C, Z is Y(═A)$R_f$, A is O.

Formula (6): X is N, Y is S(═NR), Z is Y(═A)$R_f$, A is O.

Formula (7): X is N, Y is S(═NR), Z is Y(═A)$R_f$, A is NR.

Formula (8): X is N, Y is P($R_f$), Z is Y(═A)$R_f$, A is NR.

Formula (9): X is N, Y is P(OR), Z is Y(═A)$R_f$, A is NR.

Formula (10): X is N, Y is P(NRR'), Z is Y(═A)$R_f$, A is NR.

Formula (11): X is N, Y is C, Z is Y(═A)$R_f$, A is NR.

Formula (12): X is N, Y is S(═A), Z is H, A is O.

Formula (13): X is N, Y is S(═A), Z is $R_1$—NH—$SO_2$—$R_f$, A is O.

Formula (14): X is N, Y is C, Z is O—C(═O)$R_f$, A is O.

Formula (15): X is C—R" where R" is Y(═A)—$R_f$, Y is S(═A), Z is Y(═A)$R_f$, A is O.

Formula (16): X is C—R" where R" is Y(═A)—$R_f$, Y is P($R_f$), Z is Y(═A)$R_f$, A is O.

Formula (17): X is C—R" where R" is Y(═A)—$R_f$, Y is P(OR), Z is Y(═A)$R_f$, A is O.

Formula (18): X is C—R" where R" is Y(═A)—$R_f$, Y is C, Z is Y(═A)$R_f$, A is O.

Formula (19): X is C—R" where R" is Y(═A)—$R_f$, Y is S(═NR), Z is Y(═A)$R_f$, A is O.

Formula (20): X is C—R" where R" is Y(═A)—$R_f$, Y is S(═NR), Z is Y(═A)$R_f$, A is NR.

Formula (21): X is C—R" where R" is Y(═A)—$R_f$, Y is P($R_f$), Z is Y(═A)$R_f$, A is NR.

Formula (22): X is C—R" where R" is Y(═A)—$R_f$, Y is P(OR), Z is Y(═A)$R_f$, A is NR.

Formula (23): X is C—R" where R" is Y(═A)—$R_f$, Y is C, Z is Y(═A)$R_f$, A is NR.

Formula (24): X is C—R" where R" is H, Y is P—B, Z is Y(═A)$R_f$, A is O or NR, B is OR or NRR'.

Formula (25): X is C—R" where R" is H, Y is S(═A), Z is Y(═A)$R_f$, A is O or NR.

Formula (26): X is C—R" where R" is H, Y is C, Z is Y(═A)$R_f$, A is O or NR.

Formula (27): X is C—R" where R" is alkyl, fluoroalkyl, aryl, or fluoroaryl, Y is P—B, Z is Y(═A)$R_f$, A is O or NR, B is OR or NR R'.

Formula (28): X is C—R" where R" is alkyl, fluoroalkyl, aryl, or fluoroaryl, Y is S(═A), Z is Y(═A)$R_f$, A is O or NR.

Formula (29): X is C—R" where R" is alkyl, fluoroalkyl, aryl, or fluoroaryl, Y is C, Z is Y(═A)$R_f$, A is O or NR.

Formula (30): X is N, Y is S(═O), Z is C(═O)$R_f$, A is O.

Formula (31): X is N, Y is S(═O), Z is P(═A)(—B)—$R_f$, A is O, B is OR or NRR'.

Formula (32): X is C—R" where R" is H, alkyl, fluoroalkyl, aryl, or fluoroaryl, Y is S(═O), Z is C(═A)$R_f$, A is O.

Formula (33): X is C—R" where R" is H, alkyl, fluoroalkyl, aryl, or fluoroaryl, Y is S(═O), Z is P(═A)(—B)—$R_f$, A is O, B is OR or NRR'.

Formula (34): X is C—S(═O)$R_f$, Y is S, Z is Y(═A)$R_f$, A is O.

Formula (35): X is N, Y is S, Z is Y(═A)$R_f$, A is O.

Formula (36): X is C—R" where R" is H, alkyl, fluoroalkyl, aryl, or fluoroaryl, Y is S, Z is Y(═A)$R_f$, A is O.

Examples of suitable anions of general formula (II) include, but are not limited to, anions represented by the following formulas:

(37)

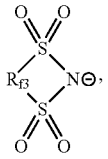

(38)

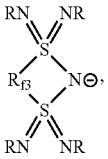

(39)

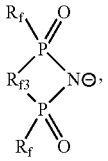

(40)

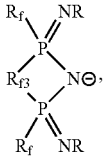

-continued (41)

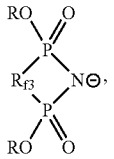

(42)

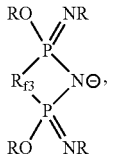

(43)

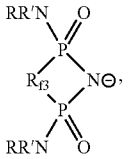

(44)

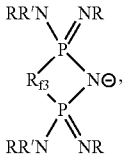

(45)

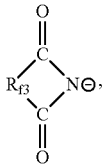

(46)

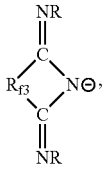

(46a)

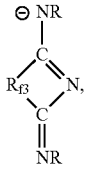

(47)

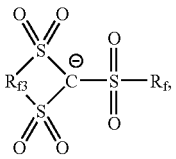

(48)

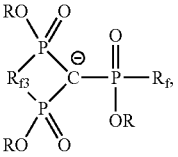

-continued (49)

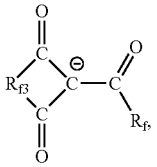

(50)

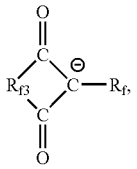

(51)

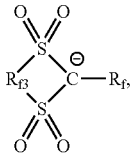

and (52)

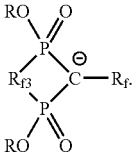

The variables of general formula (II) are as follows in formulae (37)-(52):

Formula (37): X is N, Y and Y' are S(═O), A and A' are O.

Formula (38): X is N, Y and Y' are S(═NR), A and A' are NR.

Formula (39): X is N, Y and Y' are P—$R_f$, A and A' are O.

Formula (40): X is N, Y and Y' are P—$R_f$, A and A' are NR.

Formula (41): X is N, Y and Y' are P—OR, A and A' are O.

Formula (42): X is N, Y and Y' are P—OR, A and A' are NR.

Formula (43): X is N, Y and Y' are P—NRR', A and A' are O.

Formula (44): X is N, Y and Y' are P—NRR', A and A' are NR.

Formula (45): X is N, Y and Y' are C, A and A' are O.

Formula (46,46a): X is N, Y and Y' are C, A and A' are NR. (46a is a resonance form of 46; either the conjugate acid of (46) or the conjugate acid of (46a) can be used to derive the desired salts. Formulae (46) and (46a) being resonance forms, freely interchange and are, therefore, equivalent.)

Formula (47): X is C—R", Y and Y' are S(═O), A and A' are O, R" is —$SO_2$—$R_f$.

Formula (48): X is C—R", Y and Y' are P—OR, A and A' are O, R" is —P(O)(OR)—$R_f$.

Formula (49): X is C—R", Y and Y' are C, A and A' are O, R" is —C(O)—$R_f$.

Formula (50): X is C—R", Y and Y' are C, A and A' are O, R" is $R_f$.

Formula (51): X is C—R", Y and Y' are S(═O), A and A' are O, R" is $R_f$.

Formula (52): X is C—R", Y and Y' are P—OR, A and A' are O, R" is $R_f$.

Examples of currently preferred erosion inhibitor compounds according to general formula (I) of the invention include, but are not limited to:

$$[(R_{f1}SO_2)(R_{f2}SO_2)N]^-_nM^{n+}; \quad \text{(i)}$$

$$[(R_{f1}CO)(R_{f2}CO)N]^-_nM^{n+}; \quad \text{(ii)}$$

$$[(R_{f1}CO)(R_{f2}CO)C(R)]^-_nM^{n+}; \quad \text{(iii)}$$

$$[(R_{f1}SO_2)NH]^-_nM^{n+}; \quad \text{(iv)}$$

$$[(R_{f1}CO)(R_{f2}COO)N]^-_nM^{n+}; \text{ and} \quad \text{(v)}$$

$$[(R_{f1}SO_2)—N—R_1—NH—(R_{f2}SO_2)]^-_nM^{n+}. \quad \text{(vi)}$$

Examples of currently preferred erosion inhibitor compounds according to general formula (II) of the invention include, but are not limited to:

(vii)

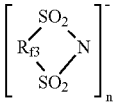

The fluoroalkyl groups of $R_f$, such as $R_{f1}$ and $R_{f2}$, have 1 to about 24 carbon atoms, preferably 1 to about 12 carbon atoms, and more preferably 1 to about 4 carbon atoms, and can be either straight-chained or branched. The fluoroalkyl groups of $R_f$ are preferably perfluoroalkyl groups. The fluorocycloalkyl groups of $R_f$, such as $R_{f1}$ and $R_{f2}$, have 4 to about 7 carbon atoms, and preferably 5 to 6 carbon atoms. The fluorocycloalkyl groups of $R_f$ are preferably perfluorocycloalkyl groups. The fluoroaryl groups of $R_f$, such as $R_{f1}$ and $R_{f2}$, have 6 to 10 carbon atoms, and preferably 6 carbon atoms. The fluoroaryl groups of $R_f$ are preferably perfluoroaryl groups. The fluoroalkaryl and fluoroaralkyl groups of $R_f$, such as $R_{f1}$ and $R_{f2}$, have 7 to about 34 carbon atoms, and preferably 7 to about 14 carbon atoms. The fluoroalkaryl and fluoroaralkyl groups of $R_f$ are preferably perfluoroalkaryl and perfluoroaralkyl groups respectively. The fluoroalkoxyalkyl groups of $R_f$, such as $R_{f1}$ and $R_{f2}$, have 3 to about 21 carbon atoms, and preferably 3 to about 6 carbon atoms. The fluoroalkoxyalkyl groups of $R_f$ are preferably perfluoroalkoxyalkyl groups. The fluoropolyalkoxyalkyl groups of $R_f$, such as $R_{f1}$ and $R_{f2}$, have 3 to about 44 carbon atoms, and preferably 4 to about 21 carbon atoms. The fluoropolyalkoxyalkyl groups of $R_f$ are preferably perfluoropolyalkoxyalkyl groups. As used herein, the term "fluoro(poly)alkoxyalkyl" refers to both fluoroalkoxyalkyl and fluoropolyalkoxyalkyl groups, and the term "perfluoro(poly)alkoxyalkyl" refers to both perfluoroalkoxyalkyl and perfluoropolyalkoxyalkyl groups. $R_f$ groups, such as $R_{f1}$ and $R_{f2}$, are preferably fluoroalkyl, fluoroalkoxyalkyl, and fluoropolyalkoxyalkyl groups, and more preferably perfluoroalkyl, perfluoroalkoxyalkyl, and perfluoropolyalkoxyalkyl groups.

The fluoroalkylene groups of $R_{f3}$ have 2 to about 6 carbon atoms, and preferably 2 to 4 carbon atoms. The fluoroalkylene groups of $R_{f3}$ are preferably perfluoroalkylene groups. The fluoroaralkylene and fluoroalkarylene groups of $R_{f3}$ have 8 to about 16 carbon atoms, and preferably 8 to 10 carbon atoms. The fluoroaralkylene and fluoroalkarylene groups of $R_{f3}$ are preferably perfluoroaralkylene and perfluoroalkarylene groups. The fluoroarylene groups of $R_{f3}$ have 6 to 10 carbon atoms. The fluoroalkoxyalkylene groups of $R_{f3}$ have 4 to about 12 carbon atoms, and preferably 4 to 6 carbon atoms. The fluoroalkoxyalkylene groups of $R_{f3}$ are preferably perfluoroalkoxyalkylene groups. The fluoropolyalkoxyalkylene groups of $R_{f3}$ have 4 to about 30 carbon atoms, and preferably 4 to 6 carbon atoms. The fluoropolyalkoxyalkylene groups of $R_{f3}$ are preferably perfluoropolyalkoxyalkylene groups. As used herein, the term "fluoro(poly)alkoxyalkylene" refers to both fluoroalkoxyalkylene and fluoropolyalkoxyalkylene groups, and the term "perfluoro(poly)alkoxyalkylene" refers to both perfluoroalkoxyalkylene and perfluoropolyalkoxyalkylene groups. $R_{f3}$ are preferably fluoroalkylene groups, and more preferably perfluoroalkylene groups.

The R group in formula (iii) is selected from H; alkyl groups having 1 to about 22, preferably 1 to about 4, carbon atoms; fluoroalkyl, and preferably perfluoroalkyl, having 1 to about 24, preferably 1 to about 8, carbon atoms; aryl having 6 to 10 carbon atoms; fluoroaryl, and preferably perfluoroaryl, having 6 to 10 carbon atoms; aralkyl having 7 to about 24, preferably 7 to about 14, carbon atoms; alkaryl having 7 to about 24, preferably 7 to about 14, carbon atoms; fluoroaralkyl, and preferably perfluoroaralkyl, having 7 to about 24, preferably 7 to about 14, carbon atoms; or fluoroalkaryl, and preferably perfluoroalkaryl, having 7 to about 24, preferably 7 to about 14, carbon atoms. R is preferably alkyl or fluoroalkyl groups. $R_1$ is selected from unsubstituted or fluoro-substituted alkylene, cycloalkylene, arylene, alkarylene, or aralkylene groups, wherein the alkylene groups are straight-chained or branched and have 1 to about 8 carbon atoms, preferably 1 to 4 carbon atoms, the cycloalkylene groups have 4 to about 7 carbon atoms, preferably 5 to 6 carbon atoms, the arylene groups have 6 to 10 carbon atoms, and the alkarylene or aralkylene groups have 7 to about 18, preferably 7 to 10, carbon atoms. $R_1$ is preferably such that the sulfonamide groups are separated by 2 or 3 carbon atoms. $R_1$ is more preferably an unsubstituted or fluoro-substituted cycloalkylene group, with cyclohexylene being most preferred.

M is a cation with a valence equal to n, wherein n is 1, 2, 3 or 4. M is preferably selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium. M is more preferably selected from inorganic cations selected from alkali metal, alkaline earth metal, zinc, Group IIIA metal, or Group IIIB metal, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium. As used herein, the Group IB, IIIA, IIIB, IVA, VA, VIA, VIIA, and VIIIA nomenclature is that of the prior IUPAC version of the Periodic Table, and the Group IIIA metals include the lanthanide series metals (particularly lanthanum, cerium, praseodymium, neodymium, europium, dysprosium, and ytterbium). The preferred alkali metal cations are lithium, sodium, potassium, and cesium. The preferred alkaline earth metal cations are magnesium and calcium. The preferred Group IIIA metal cations are lanthanum and cerium. The preferred Group IVA metal cations are titanium and zirconium. The preferred Group VA metal cations is vanadium. The preferred Group VIA metal cation is chromium(III). The preferred Group VIIA metal cation is manganese. The preferred Group VIIIA metal cations are iron, cobalt, and nickel. The preferred Group IB metal cations are copper and silver. The preferred Group IIIB metal cation is aluminum. The tetrasubstituted ammonium and phosphonium cations are substituted with independently selected alkyl groups each having 1 to about 24, preferably 1 to about 4, carbon atoms; aryl groups having 6 to 10 carbon atoms, preferably phenyl; and aralkyl or alkaryl groups having 7 to about 34, preferably 7 to about 14, carbon atoms. The total number of carbon atoms in the tetrasubstituted ammonium and phosphonium cations is 4 to about 38, preferably 5 to about 21. An example of a preferred tetrasubstituted ammonium or phosphonium cation where the substituents are not all identical is represented by the formula $(CH_3)_3NR^+$ wherein R is 1 to about 18 carbon atoms. The alkyl substituted imidazolium cations are substituted with two to five alkyl groups, wherein each alkyl substituent is independently 1 to 22 carbon atoms. The total number of carbon atoms in the alkyl substituted imidazolium cations is 5 to about 31, i.e. the total number of carbon atoms in the alkyl substituents of the imidazolium ring is 2 to about 28, and the alkyl substituted imidazolium cations have one alkyl group attached to each nitrogen atom of the imidazolium ring. The preferred cations will vary depending on the particular anion of the erosion inhibitor(s) of the invention. In particular, the preferred cations are those in which the erosion inhibitor compounds of the invention are essentially soluble in the functional fluid of the invention at the concentration in which the erosion inhibitor compounds are used, and in which the erosion inhibitor compounds of the invention will be effectively ionized in the functional fluid compositions of the invention. More preferably, the erosion inhibitor compounds of the invention are completely soluble in the functional fluid of the invention at the concentration in which the erosion inhibitor compounds are used.

The erosion inhibitor compounds of the invention are useful when employed in an effective amount in the functional fluid, e.g. a hydraulic fluid, of the invention using a phosphate ester-based basestock. Typically, an effective amount of erosion inhibitor is at least 1.0 micromole erosion inhibitor per 100 g total fluid composition. Preferably, the effective amount of erosion inhibitor is in the range from about 10 to about 200, more preferably from about 20 to about 150, micromoles erosion inhibitor per 100 g total fluid composition.

The currently preferred fluorosulfonimide salts of formula (i) are effective when M is selected from alkali metal, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the fluorosulfonimide salts of formula (i) are lithium, potassium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium and tetrabutylammonium being currently most preferred due to results achieved therewith.

Examples of suitable fluorosulfonimide salts of formula (i) include, but are not limited to, lithium, potassium, tetramethylammonium, tetrabutylammonium, tetramethylphosphonium, tetrabutylphosphonium, magnesium, calcium, or lanthanum bis(trifluoromethanesulfonyl)imidate; lithium, potassium, tetramethylammonium, tetrabutylammonium, tetramethylphosphonium, tetrabutylphosphonium, magnesium, calcium, or lanthanum bis(nonafluorobutanesulfonyl)imidate; lithium, potassium, tetramethylammonium, tetrabutylammonium, tetramethylphosphonium, tetrabutylphosphonium magnesium, calcium, or lanthanum bis(perfluoroethoxyethylsulfonyl)imidate; lithium, potassium, tetramethylammonium, tetrabutylammonium, tetramethylphosphonium, tetrabutylphosphonium, magnesium, calcium, or lanthanum bis(pentafluoroethanesulfonyl)imidate; and mixtures thereof.

The currently preferred fluoro(carbox)imide salts of formula (ii) are effective when M is selected from lithium, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the fluoro(carbox) imide salts of formula (ii) are lithium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium and tetrabutylammonium being currently most preferred.

Examples of suitable fluoro(carbox)imide salts of formula (ii) include, but are not limited to, lithium, tetramethylammonium, tetrabutylammonium, tetramethylphosphonium, tetrabutylphosphonium magnesium, calcium, or lanthanum bis(trifluoroacet)imidate, and mixtures thereof.

The currently preferred fluoroacetoacetone salts of formula (iii) are effective when M is selected from lithium, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the fluoroacetoacetone salts of formula (iii) are lithium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium and tetrabutylammonium being currently most preferred.

Examples of suitable fluoroacetoacetone salts of formula (iii) include, but are not limited to, lithium, tetramethylammonium, tetrabutylammonium, tetramethylphosphonium, tetrabutylphosphonium, magnesium, calcium, or lanthanum hexafluoroacetoacetonate, and mixtures thereof.

The currently preferred fluorosulfonamide salts of formula (iv) are effective when M is selected from alkali metal, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the fluorosulfonamide salts of formula (iv) are lithium, potassium, sodium, cesium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium and tetrabutylammonium being currently most preferred.

Examples of suitable fluorosulfonamide salts include, but are not limited to, lithium, potassium, sodium, cesium, tetramethylammonium, tetrabutylammonium, tetramethylphosphonium, tetrabutylphosphonium, magnesium, calcium, or lanthanum trifluoromethane-sulfonamidate, and mixtures thereof.

The currently preferred fluoro-O-acetohydroxamic acid salts of formula (v) are effective when M is selected from lithium, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the fluoro-O-acetohydroxamic acid salts of formula (v) are lithium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium and tetrabutylammonium being currently most preferred.

Examples of suitable fluoro-O-acetohydroxamic acid salts include, but are not limited to, lithium, tetramethylammonium, tetrabutylammonium, tetramethylphosphonium, tetrabutylphosphonium, magnesium, calcium, or lanthanum salts of bis(trifluoroacetyl)hydroxylamine, and mixtures thereof.

The currently preferred bis(fluorosulfonamide) salts of formula (vi) are effective when M is selected from alkali metal, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the bis(fluorosulfonimide) salts of formula (vi) are lithium, potassium, sodium, cesium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium and tetrabutylammonium being currently most preferred.

Examples of suitable bis(fluorosulfonamide) salts include, but are not limited to, lithium, potassium, sodium, cesium, tetramethylammonium, tetrabutylammonium, tetramethylphosphonium, tetrabutylphosphonium, magnesium, calcium, or lanthanum trans-N,N'-1,2-cyclohexanediylbis(1,1,1-trifluoromethanesulfonamidate), and mixtures thereof.

The currently preferred cyclic fluoroalkylenedisulfonylimide salts of formula (vii) are effective when M is selected from alkali metal, alkaline earth metal, Group IIIa metal, Group IIIb metal, zinc, alkyl, aryl or mixed alkyl/aryl tetrasubstituted ammonium, alkyl, aryl or mixed alkyl/aryl tetrasubstituted phosphonium, or alkyl substituted imidazolium cations. The currently preferred cations for use with the cyclic fluoroalkylenedisulfonylimide salts of formula (vii) are lithium, potassium, sodium, cesium, tetraalkylammonium, tetraalkylphosphonium, magnesium, calcium, aluminum, and lanthanum, with lithium, magnesium, lanthanum, tetramethylammonium, tetrabutylammonium, tetramethylphosphonium, and tetrabutylphosphonium being more preferred, and lithium, and tetrabutylammonium being currently most preferred.

Examples of suitable cyclic fluoroalkylenedisulfonylimide salts include, but are not limited to, lithium, potassium, sodium, cesium, tetramethylammonium, tetrabutylammonium, tetramethylphosphonium, tetrabutylphosphonium, magnesium, calcium, or lanthanum cyclic-1,3-perfluoropropanedisulfonimide; lithium, tetramethylammonium, tetrabutylammonium, tetramethylphosphonium, tetrabutylphosphonium or magnesium cyclic-1,2-perfluoroethanedisulfonimide; and mixtures thereof.

The erosion inhibitor compounds of the invention can generally be prepared by preparing the salt of the appropriate conjugate acid precursor using any conventional method known to one of ordinary skill in the art. Either the conjugate acid precursors or the corresponding salts are commercially available or can be prepared by methods known to one of ordinary skill in the art.

The majority of the above formulae are either imidates or methides. The imidates (salts of imides) are anions wherein X of generic formula (I) or (II) is N, and Z is also of form Y═A. The methides are anions wherein X of generic formula (I) or (II) is C—R". In the broadest sense, the imides, e.g. conjugate acids of formulae (1)-(10), (31), (35), and (37)-(46) can be made by reaction of corresponding acid halides [$R_f$—Y(═A)-Halogen] with ammonia. Noncyclic asymmetric versions can be prepared by reaction of halide with the intermediate corresponding amide. In a broad sense, the conjugate acids of the methides of formulae (15)-(29), (32)-(34), (36), and (47)-(52) can generally be prepared by reaction of corresponding acid halides with appropriate precursor methide anion (e.g. alkyl or benzyl metalloid species, such as methyllithium, benzylmagnesium chloride). This process can be repeated to construct multiply substituted methides. There are, as disclosed below, other routes known or available to some of the erosion inhibitor compounds of the invention.

The erosion inhibitor compound anions of formulas (1) and (37), which correspond to the erosion inhibitor compounds of formulas (i) and (vii), can be prepared according to the methods disclosed in U.S. Pat. Nos. 5,874,616; 5,652,072; and 4,387,222, which are incorporated by reference herein in their entirety. Alternatively, one can utilize an aqueous matrix for the preparation of the salt of the free acid imide, and the water evaporated under heat and vacuum. For example, tetrasubstituted ammonium and tetrasubstituted phosphonium hydroxides used to prepare the corresponding salts can be used as aqueous solutions. If so, these aqueous solutions could be added to the imide in either in water or methyl t-butyl ether, depending on the solubility of the free imide, and the product isolated substantially as described in the patents, provided sufficient heat, vacuum, and time are utilized to remove the bulk of the water before the toluene treatment. It would be readily apparent to one of ordinary skill in the art how to use the teachings of the '616, '072, and '222 patents, with or without obvious variations in the methods disclosed therein, to prepare the compounds of formulas (i) and (vii). For example, the perfluoro(poly)alkoxyalkylsulfonimides and cyclic perfluoro(poly)alkoxyalkylenedisulfonimides can be readily prepared using known perfluoro(poly)alkoxyalkylsulfonyl compounds wherein methods readily known to one of ordinary skill in the art are used to prepare the perfluoro(poly)alkoxyalkylsulfonyl fluorides and sulfonimides therefrom.

The conjugate acid of the erosion inhibitor compound anions of formula (2) can be prepared according to the method disclosed in Pavlenko, N. V.; Matyushecheva, G. I.; Semenii, V. Ya.; Yagupol'skii, L. M., USSR. Zh. Obshch. Khim. (1985), 55 (7), 1586-90. (CAN 105:42926) which specifically describes the preparation of material where Rf=C3F7 (heptafluoropropyl). The erosion inhibitor compounds are prepared by preparing the desired salt of the appropriate conjugate acid precursor using conventional methods.

The erosion inhibitor compound anions of formula (3) can be prepared by reacting the appropriate phosphonyl halide with the appropriate phosphonamide or with ammonia to yield unsymmetrical or symmetrical phosphonimides, respectively. For example, phosphonamides, $R_f$—P(═O)(OR)—$NH_2$, with $R_f$=$CHF_2$, $CH_2F$ and R=H, or with $R_f$=$CF_3$, R=p-tolyl, and N substituted once with chlorophenyl can be reacted with phosphonyl halides, $R_f$—P(═O)(OR)—X, with $R_f$=$CF_3$ or fluoroalkenyl, R=$C_1$-$C_4$, and X═Cl or F. These phosphonimides would then be treated with base in the manner of the general preparation of salts of this invention, such as described herein, to prepare the desired erosion inhibitor compounds.

The erosion inhibitor compound anions of formula (4) can be prepared according to the method disclosed in Pavlenko, N. V.; Matyushecheva, G. I.; Semenii, V. Ya.; Yagupol'skii, L. M., USSR. Zh. Obshch. Khim. (1985), 55 (7), 1586-90. (CAN 105:42926) which specifically describes the preparation of material where $R_f$=$C_3F_7$ (heptafluoropropyl) and R, R'=H. The erosion inhibitor compounds are prepared by preparing the desired salt of the appropriate conjugate acid precursor using conventional methods.

The erosion inhibitor compound anions of formula (5), which correspond to the erosion inhibitor compounds of formula (ii), are commercially available or can be prepared by reacting the imide starting material and an appropriate base to form the salt. For example, bis(trifluoroacet)imide is available from Fluka Chemie AG. The preparation of the imide starting materials are readily known to one of ordinary skill in the art. The salt can be prepared by any conventional method known to one of ordinary skill in the art, such as by combining stoichiometric amounts of imide and metal hydroxide in an aqueous solution or slurry, heating to 20-70° C., and stirring until a solution is formed. Water is then evaporated to yield the salt. Preparation of the cesium salt is described in Example 7 of U.S. Pat. No. 5,350,646. The perfluorocarboximides can also be prepared according to the method described in Ye, F.; Noftle, R. E., Dept. Chem., Wake Forest Univ., Winston-Salem, N.C., USA, Journal of Fluorine Chemistry (1997), Volume Date 1996-1997, 81 (2), 193-196 (CAN 127:65495).

The erosion inhibitor compound anions of formula (6) are disclosed in Burk, Peeter; Koppel, Ilmar A.; Koppel, Ivar; Yagupolskii, Lev M.; Taft, Robert W., Inst. Chem. Physcis, Tartu Univ., Tartu, Estonia, Journal of Computational Chemistry (1996), 17 (1), 30-41 (CAN 124:201507). Conjugate acids of anions of formula (6) can be prepared by the reaction of ammonia with azasulfonyl halides such as those precursors shown below. This reaction is analogous to that discussed above for the preparation of materials of formulas (2) and (4).

Precursors:

59665-14-4

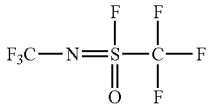

79823-98-6

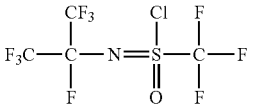

79823-99-7

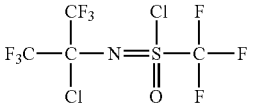

-continued 79824-00-3

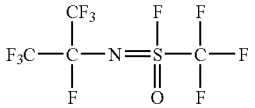

as disclosed in the following literature references: *Reactions of (trifluoromethylimino)(trifluoromethyl)sulfur trifluoride with nucleophiles and the preparation of CF3SF4N(F)Rf (Rf=trifluoromethyl, pentafluoroethyl)*, Yu, Shin-Liang; Shreeve, Jeanne M., J. Fluorine Chem. (1976), 7 (1-3), 85-94 (CAN 85:32347); *Sulfur(VI) oxide chloride imides and sulfur(VI) oxide fluoride imides*, Mews, Ruediger; Kricke, Peter; Stahl, Ingo., Anorg. Chem. Inst., Univ. Goettingen, Goettingen, Fed. Rep. Ger., Z. Naturforsch., B: Anorg. Chem., Org. Chem. (1981), 36B (9), 1093-8 (CAN 95:214367); and *Fluorine chemistry of sulfur(VI) compounds*, Yu, Shin-Liang, (1975), 108 pp., from: Diss. Abstr. Int. B 1976, 36(11), 5582 (CAN 85:62598). The corresponding erosion inhibitor compounds can be prepared by preparing the desired salt of the appropriate conjugate acid precursor using conventional methods.

The compound

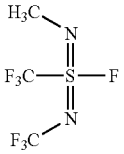

is disclosed in: Yu, Shin-Liang; Shreeve, Jeanne M. Reactions of (trifluoromethylimino)(trifluoromethyl)sulfur trifluoride with nucleophiles and the preparation of CF3SF4N(F)Rf (Rf=trifluoromethyl, pentafluoroethyl)., J. Fluorine Chem. (1976), 7 (1-3), 85-94 (CAN 85:32347) and Fluorine chemistry of sulfur(VI) compounds, (1975), 108 pp. (CAN 85:62598). Such a material should be a ready precursor to conjugate acids corresponding to the anions of formula (7), by reaction of the sulfonyl fluoride with ammonia, in a manner analogous to the preparation of the compounds of formula (1), (2) and (4) described herein. The corresponding erosion inhibitor compounds can be prepared by preparing the desired salt of the appropriate conjugate acid precursor using conventional methods.

The conjugate acid precursors to the erosion inhibitor compound anions of formula (8) can be prepared as follows. Based on the teachings in the paper *Bifunctional bis(perfluoroalkylphosphazo) compounds*, Sokolov, E. I.; Sharov, V. N.; Klebanskii, A. L.; Korol'ko, V. V.; Prons, V. N., Vses. Nauchno-Issled. Inst. Sint. Kauch. im. Lebedeva, Leningrad, USSR, Zh. Obshch. Khim. (1975), 45 (10), 2346-7 (CAN 84:59664), the reaction of $(R_f)_2PCl_3$ with $RNH_2$ under conditions similar to those disclosed in that paper should produce $(R_f)_2P(Cl)$═NR. This material would then be reacted with ammonia to produce the phosphinimide. The corresponding erosion inhibitor compounds can be prepared by preparing the desired salt of the appropriate conjugate acid precursor using conventional methods. Materials $(R_f)_2PCl_3$ are known, and their preparation are described in the literature, e.g. Mahmood, Tariq; Shreeve, Jean'ne M., *New perfluoroalkylphosphonic and bis(perfluoroalkyl)phosphinic*

*acids and their precursors*, Inorg. Chem. (1986), 25 (18), 3128-31 (CAN 105:226810) and Gosling, Keith; Burg, Anton B., *Bis(trifluoromethyl)dithiophosphinic acid and related derivatives*, J. Amer. Chem. Soc. (1968), 90 (8), 2011-15 (CAN 69:19257).

The erosion inhibitor compound anions of formula (9) can be prepared as follows. Compounds of the formula $R_fPF_4$ are known in the art. Conversion of compounds of the formula $R_fPF_4$ to compounds of the formula $R_fP(OR')F_3$ can be done according to the teachings in the art for the production of compounds of the formula $RP(OR')F_3$. Compounds of the formula $R_fP(OR')F_3$ can then be converted to compounds of formula (9) according to the methodology disclosed to produce compounds of formula (8) stepwise from compounds of the formula $(R_f)2PCl_3$, $RNH_2$, and ammonia. The corresponding erosion inhibitor compounds can be prepared by preparing the desired salt of the appropriate conjugate acid precursor using conventional methods.

The erosion inhibitor compound anions of formula (10) can be prepared as follows. Preparation of materials $R_fP(NR_2)X_3$ and $R_fP(N(R_f')_2)X_3$ are known. Two papers, i.e. Fokin, A. V.; Drozd, G. I.; Landau, M. A., *Structure of aminoperfluoroalkylfluorophosphoranes*, Zh. Strukt. Khim. (1976), 17 (2), 385-9 (CAN 85:62353), and Fokin, A. V.; Landau, M. A.; Drozd, G. I.; Yarmak, N. P., *Fluorine-19, phosphorus-31, and proton NMR spectra of bis(trifluoromethyl)aminophosphoranes*, Izv. Akad. Nauk SSSR, Ser. Khim. (1976), (10), 2210-17 (CAN 86:81293) disclose the $R_fP(NR_2)X_3$ materials. A preparation for $R_fP(N(Rf')_2)X_3$ is disclosed in the paper Ang, H. G., *Oxidative addition of trifluoromethylhalophosphines with N-chlorobis(trifluoromethyl)amine*, J. Fluorine Chem. (1973), Volume Date 1972-1973, 2 (2), 181-9 (CAN 77:164801). Such materials can be used as precursors to produce compounds corresponding to the anions of formula (10), according to the process described above for preparation of compounds of formula (8). The corresponding erosion inhibitor compounds can be prepared by preparing the desired salt of the appropriate conjugate acid precursor using conventional methods.

Conjugate acids of the erosion inhibitor compound anions of formula (11) are readily known. In the case where R=H, they can be readily prepared by reaction of appropriate amidines with nitrites such as disclosed in *Synthesis of N-(perfluoroacyl-imidoyl)perfluoro-alkylamidines and perfluorosubstituted triazine compounds based on them*, Fedorova, G. B.; Dolgopol'skii, I. M. Vses. Nauch.-Issled. Inst. Sin. Kauch. im. Lebedeva, Leningrad, USSR, Zh. Obshch. Khim. (1969), 39 (12), 2710-16 (CAN 72:90411). The corresponding erosion inhibitor compounds can be prepared by preparing the desired salt of the appropriate conjugate acid precursor using conventional methods.

The erosion inhibitor compound anions of formula (12), which correspond to the erosion inhibitor compounds of formula (iv), can be prepared according to the method disclosed in U.S. Pat. No. 4,370,254, which is incorporated by reference herein. The corresponding erosion inhibitor compounds can be prepared by preparing the desired salt of the appropriate conjugate acid precursor using conventional methods.

The erosion inhibitor compound anions of formula (13), which correspond to the erosion inhibitor compounds of formula (vi), can be prepared by combining equivalent amounts of the bisamide $R_fSO_2NH—R_1—NHSO_2R_f$ and a suitable base in aqueous solution or slurry, heating to 20-70° C., and stirring until a homogeneous solution is formed. Water is then evaporated to yield the salt. The preparation of the bisamide starting materials are readily known to one of ordinary skill in the art.

Conjugate acids of the erosion inhibitor compound anions of formula (14), which correspond to the erosion inhibitor compounds of formula (v), can be prepared according to the methods disclosed by Tomooka, C. S., LeCloux, D. D., Sasaki, H., and Carreira, E. M., Organic Letters (1999), 1 (1), 149-151 (CAN 131:87501). The corresponding erosion inhibitor compounds can be prepared by preparing the desired salt of the appropriate conjugate acid precursor using conventional methods.

The conjugate acids of the erosion inhibitor compound anions of formula (15) are well known. Their preparation is described in U.S. Pat. No. 3,333,007. The corresponding erosion inhibitor compounds can be prepared by preparing the desired salt of the appropriate conjugate acid precursor using conventional methods.

The erosion inhibitor compound anions of formula (16) can be prepared as follows. The mono-P methanes $[(R_f)_2P(=O)—CH_3]$ are known.: Pavlenko, N. V.; Matyushecheva, G. I.; Semenii, V. Ya.; Yagupol'skii, L. M., *Reaction of difluorotris(perfluoroalkyl)phosphoranes with organolithium compounds*, Zh. Obshch. Khim. (1987), 57 (1), 117-20 (CAN 108:6098) and The, Kwat I.; Cavell, Ronald G., *Phosphoranes. 4. Methylbis(trifluoromethyl)phosphoranes, $CH_3(CF_3)_2PXY$, with monofunctional [fluoro, chloro, methoxy, dimethylamino] substitutents*, Inorg. Chem. (1977), 16 (6), 1463-70 (CAN 87:6086). Additionally, materials $(R_f)_2P(=O)X$ are known wherein $R_f$ is $C_{1-4}$ and X is F or Cl. The methanes can be treated with sufficiently strong base to generate the anion, and this treated with the halides to generate $(R_f)_2P(=O)—CH2—P(=O)(R'_f)_2$. These materials will be more acidic than the starting mono-P methanes. The process would then be repeated to afford the parent acids of materials of formula (16). The corresponding erosion inhibitor compounds can be prepared by preparing the desired salt of the appropriate conjugate acid precursor using conventional methods.

The erosion inhibitor compound anions of formula (17) can be prepared as follows. The monophosphonomethanes, $R_fP(=O)(OR)—CH_3$, and the phosphonyl halides, $R_fP(=O)(OR)X$ (where X is halogen), are known. Reaction of the former with base to generate the methide, and subsequent reaction with the halide should, by repetition as described above for compounds of formula (16), lead to the parent acids of materials of formula (17). The corresponding erosion inhibitor compounds can be prepared by preparing the desired salt of the appropriate conjugate acid precursor using conventional methods.

The erosion inhibitor compound anions of formula (18) are readily known or they can be prepared by reaction of fluoroalkanoylfluorides with fluoroalkanoyl-anhydrides as described in *Tris(perfluoroacyl)methanes*, Rokhlin, E. M.; Volkonskii, A. Yu, Inst. Elementoorg. Soedin., Moscow, USSR, Izv. Akad. Nauk SSSR, Ser. Khim. (1979), (9), 2156 (CAN 92:146215). The corresponding erosion inhibitor compounds can be prepared by preparing the desired salt of the appropriate conjugate acid precursor using conventional methods.

The erosion inhibitor compound anions of formula (19) can be prepared as follows. Sprectroscopic studies have been done on $R_fS(=NR)(=O)—CH_3$, where R is $—SO_2R'_f$ in *Multinuclear NMR spectroscopy and quantum-chemical studies of sulfur compounds with strong electron-withdrawing groups*, Bzhezovsky, Vladimir; Penkovsky, Vladimir, Inst. Org. Chem., Natl. Acad. Sci., Kiev, Ukraine; Phosphorus, Sulfur Silicon Relat. Elem. (1994), 95 & 96 (1-4), 413-14 (CAN 122:264815). Certain halides $R_fS(=NR)(=O)X$ are known, wherein $R=R'_f$. Thus the desired parent acids of compounds of formula (19) could be made by the procedure employed for materials of formulas (16) and (17) above, i.e. reaction of the methane with base to generate the methide, then reaction of the methide with the halide to produce $R_fS(=O)(=NSO_2R'_f)—CH_2—S(=O)(=NR''_f)R_f$. This in turn would be treated with base to create the corresponding methide, and this methide reacted with another mole of halide to produce the parent acid of materials of formula (19). The corresponding erosion inhibitor compounds can be prepared by preparing the desired salt of the appropriate conjugate acid precursor using conventional methods.

The erosion inhibitor compound anions of formula (20) can be prepared as follows. The compounds $F_3C—N=S(=NCH_3)(CF_3)—F$ are known, such as disclosed in: Yu, Shin-Liang, *Fluorine chemistry of sulfur(VI) compounds*, (1975), 108 pp. (CAN 85:62598) and Yu, Shin-Liang; Shreeve, Jeanne M., *Reactions of (trifluoromethylimino)-(trifluoromethyl)sulfur trifluoride with nucleophiles and the preparation of $CF_3SF_4N(F)R_f$ ($R_f$=trifluoromethyl, pentafluoroethyl)*, J. Fluorine Chem. (1976), 7 (1-3), 85-94 (CAN 85:32347). The monosubstituted methanes, $(CF_3)—(F_3CSO_2—N=)_2S—CH_3$, are also known, such as disclosed in: Bzhezovsky, Vladimir; Penkovsky, Vladimir, *Multinuclear NMR spectroscopy and quantum-chemical studies of sulfur compounds with strong electron-withdrawing groups*, Phosphorus, Sulfur Silicon Relat. Elem. (1994), 95 & 96 (1-4), 413-14 (CAN 122:264815). Multistep generation of methide, and reaction with halide, such as described above, should result in the preparation of the trisubstituted methane parent of formula (20), at least in the case where R is the activating $—SO_2R'_f$. The corresponding erosion inhibitor compounds can be prepared by preparing the desired salt of the appropriate conjugate acid precursor using conventional methods.

The erosion inhibitor compound anions of formula (21) can be prepared as follows. The halides $(R_f)_2P(=NR)—X$ can be prepared by reaction of the appropriate amines $RNH_2$ with $(R_f)_2PX_3$ (see discussion above, formula (10)). Certain phosphorus dihalides, $(R_f)_2PX_2CH_3$, are known, including $(F_3C)_2PCl_2CH_3$ and $(F_7C_3)_2PF_2CH_3$. Using the method described above for formula (10), these could be reacted with primary amines to form the monophosphorus methanes, $(R_f)_2P(=NR)CH_3$. These monophosphorus methanes could be treated with base to form the conjugate methide anions, and these reacted with the halides $(R_f)_2P(=NR)—X$ [formed from $(R_f)_2PX_3+RNH_2$], these steps done twice, to afford the trisubstituted methanes which are parent acids to the compounds of formula (21). The corresponding erosion inhibitor compounds can be prepared by preparing the desired salt of the appropriate conjugate acid precursor using conventional methods.

The erosion inhibitor compound anions of formula (22) can be prepared as follows. The compounds $R_f—PX_4$, where X=Cl, and $R_f=CF_3$ or $C_2F_5$ are known. $R_f—PX_4$ can be selectively reacted with a single equivalent of primary amine to form the intermediate $R_fP(=NR)X_2$ or with a single equivalent of alcohol to form the intermediate $R_fP(OR)X_3$. Then reaction with the other species, i.e. the alcohol or the amine, would result in formation of $R_fP(OR)(=NR')X$. It remains necessary to introduce methide, which is believed to be feasible via Grignard $H_3CMgX$ or methyllithium $H_3CLi$. Once having produced the building blocks of monohalide and P-methane, the anion of the substituted methane can be generated and subsequently reacted with monohalide units to build the trisubstituted methane. The corresponding erosion inhibitor compounds can be prepared by preparing the desired salt of the appropriate conjugate acid precursor using conventional methods.

The erosion inhibitor compound anions of formula (23) can be prepared as follows. The homologous triacylmethane can be reacted with primary amine to form the conjugate acid of materials of formula (23). The Shiff base reaction of carbonyl compounds with primary amines is well-known in organic chemistry. See the above discussion of formula (18) materials for the preparation of the triacylmethanes. The corresponding erosion inhibitor compounds can be prepared by preparing the desired salt of the appropriate conjugate acid precursor using conventional methods.

The erosion inhibitor compound anions of formula (24) can be prepared as follows. The following method is disclosed for preparing compounds of formula (24)(i) wherein A=NR', B=OR. It is known in the literature that sulfonyl fluorides can be reacted with Grignard reagents (e.g. MeMgBr) to produce bis(sulfonyl)methanes. Based on this known reaction, the intermediate species

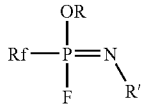

should react similarly with Grignard reagents, generating the conjugate acids to anions of formula (24)(i) wherein A=NR' and B=OR, provided the Grignard reagent does not react with the P=N bond. Preparation of intermediates of the above structure was disclosed above in the description of preparation of materials of formula (9). The following method is disclosed for preparing compounds of formula (24)(ii) wherein A=O, B=OR. Alkyl fluoroalkyl phosphinates are known in the literature. Generation of the corresponding methide anion from the alkyl fluoroalkyl phosphinate $R_fP(O)(OR)CH_2R'$ (as known with monosulfonylmethanes), followed by reaction with fluoroalkyl phosphonyl halides $R_fP(O)(OR)X$ should produce the conjugate acids of anions of formula (24)(ii) wherein A=O, B=OR. The following method is disclosed for preparing compounds of formula (24)(iii) wherein A=O, $B=NR_2$. Fluoroalkylphosphinamidic chlorides are known and can be prepared as exemplified by reaction of $CF_3NO$ with $(CF_3)_2PCl$ to produce $(CF_3)_2NP(O)(CF_3)Cl$. Similar to the description above for formula (24)(i), reaction of the halide with methyl Grignard reagent should produce the conjugate acids of anions of Formula (24)(iii). The following method is disclosed for preparing compounds of formula (24)(iv) wherein A=NR, $B=NR'_2$. Compounds $R_f—P(NR_2)X_3$, wherein X is halogen, are known (see discussion for synthesis of compounds of formula (10)). As described in the synthesis of compounds of formulas (8) and (10), reaction of this precursor with $H_2NR$ should produce compounds $R_f—P(NR'_2)(=NR)—X$. Reaction of such a material with methide anion (e.g., methyllithium or methylmagnesium bromide) should produce the following compound (I).

(I)

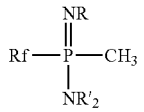

(II)

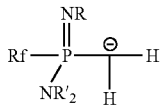

Treatment of this compound (I) with base (e.g. methyllithium) should produce the anion (II), which upon reaction with a second equivalent of $R_f$—P(NR'$_2$)(═NR)—X would yield the conjugate acids of compounds of formula (24)(iv) wherein A=NR and B=—NR'$_2$. The corresponding erosion inhibitor compounds can be prepared by preparing the desired salt of the appropriate conjugate acid precursor using conventional methods.

The erosion inhibitor compound anions of formula (25) can be prepared as follows. The conjugate acid wherein A=O and $R_f$=$CF_3$ (Bis(trifluoromethyl-sulfonyl)methane) is commercially available from ABCR GmbH KG. Other disulfonylmethane materials are well known in the literature, including the conjugate acids, their anions and various salts. For example, a reference for their preparation is: *Preparation of bis(perfluoroalkylsulfonyl)methanes*, Yamamoto, Takashi; Watanabe, Hiroyuki. (Fosoh Akzo Corp., Japan). Jpn. Kokai Tokkyo Koho (2001), 6 pp., JP 2001039942 A2 20010213, Application: JP 99-211104 19990726 (CAN 134: 162746). The conjugate acid wherein A=NR can be prepared by the following exemplary method. The literature reference, *Reactions of (trifluoromethylimino)(trifluoromethyl) sulfur trifluoride with nucleophiles and the preparation of CF3SF4N(F)Rf (Rf=trifluoromethyl, pentafluoroethyl)*, Yu, Shin-Liang; Shreeve, Jeanne M., J. Fluorine Chem. (1976), 7(1-3), 85-94. (CAN 85:32347) discloses the substitution reaction of $CF_3N{:}SF_3CF_3$ (I) with $MeNH_2$ to produce $(CF_3N{:})_2SFCF_3$. Provided the Grignard reagent does not react with the S═N—R functional group, and in analogy to the proven reaction with sulfonyl halides $R_f$—$SO_2$—X, compounds of the above type should react with Grignard reagents $RCH_2MgX$ to produce the conjugate acids of anions of formula (25) wherein A=N—R.

The erosion inhibitor compound anions of formula (26) can be prepared as follows. For the subcase of A=O on both sides of the molecule, the conjugate acids are readily available articles of commerce. Materials may be obtained from ABCR, Fluka, Lancaster Synthesis, Matrix, and the like, wherein $R_f$ is anywhere from —$CF_3$ to perfluoro-$C_7$. A few of the metal salts are also commercially available, such as Mg, Ca, and Al salts, from ABCR, Alfa-Aesar, or Strem. For the subcase of A=NR on both sides of the molecule, the material $F_3C$—C(═NH)—CF═CH($NH_2$)—$CF_3$, which is a tautomer of $F_3C$—C(═NH)—CFH—C(═NH)—$CF_3$, is available from ABCR. A number of members of this family are known in the literature: $R_f$=$C_1$-$C_3$, R=H, n-Bu, and substituted aryl, and R'=H, $CH_3$, CN, F, and Cl. Furthermore, for the subcase of one A being ═O and the other being ═NR, a number of these compounds are known in the literature, although they usually have complexly substituted or hetero-groups R attached to N. In each case, the corresponding erosion inhibitor compounds can be prepared by preparing the desired salt of the appropriate conjugate acid precursor using conventional methods. In addition, the erosion inhibitor compound anions of formula (26), which correspond to the erosion inhibitor compounds of formula (iii), can be prepared by contacting the appropriate starting material, e.g. hexafluoroacetoacetone, with an appropriate base, e.g. metal hydroxide such as LiOH $H_2O$, in water to form a clear solution. The clear solution is then evaporated under vacuum to produce the dry salt.

The erosion inhibitor compound anions of formulae (27), (28), and (29) wherein R" is alkyl or (per)fluoroalkyl can be prepared by reacting the corresponding anion of formulae (24), (25), and (26) with an alkyl halide R"X (X=halogen, preferably Cl, Br, or I) to form the conjugate acid precursor, then preparing the desired salt of the conjugate acid precursor using conventional methods. In addition to the method corresponding to the method described above for compounds of formula (24), compounds of formula (27) can be prepared by employing a similar synthetic route with the exception that instead of using methyllithium or methylmagnesium bromide, one uses an alkyllithium or alkylmagnesium bromide, or arylmethyl (e.g. benzyl)magnesium bromide to generate intermediate (I), wherein instead of methyl the substituent is alkyl or arylmethyl. In (II), one of the hydrogens is replaced with R'=alkyl or aryl. Compounds of formula (28) in which R" is alkyl or aryl are known in the art. In cases for formulae (27) and (29) wherein R" is aryl or (per)fluoroaryl, corresponding anionic substances to the left-hand formulae in the reactions below are reacted with the corresponding acid halides $R_fP$(═A)(B)X, $R_fS$(═A)2X or $R_fC$(═A)X, to afford the conjugate acids of anions of formulae (27) and (29), respectively.

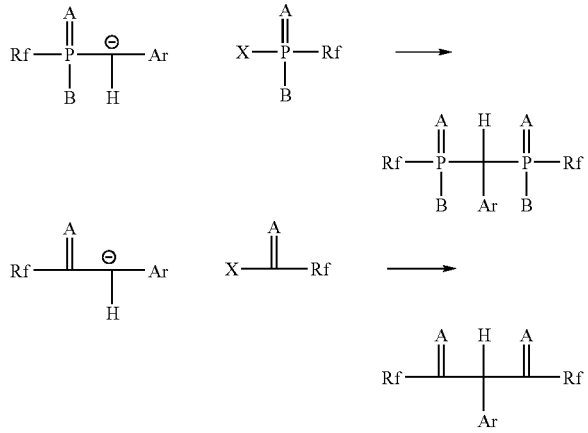

The desired salt is then prepared using conventional methods.

The erosion inhibitor compound anions of formula (30) can be prepared according to the method described above for preparing the anions of formula (5), i.e. the mixed perfluoro carboxy/sulfonimides can be prepared according to the method described in Ye, F.; Noftle, R. E., Dept. Chem., Wake Forest Univ., Winston-Salem, N.C., USA, Journal of Fluorine Chemistry (1997), Volume Date 1996-1997, 81(2), 193-196 (CAN 127:65495). In addition, *Fluorinated isocyanates—reactions with fluorinated anhydrides, acids, and related substrates*, De Pasquale, Ralph J., PCR, Inc., Gainesville, Fla., USA., J. Fluorine Chem. (1976), 8 (4), 311-21, (CAN 85:159603) describes the preparation of the cross imide. The corresponding erosion inhibitor compounds can be prepared by preparing the desired salt of the appropriate conjugate acid precursor using conventional methods.

The erosion inhibitor compound anions of formula (31) can be prepared as follows. (Per)fluorosulfonamides and (per)fluorophosphonamides are known. These materials can be reacted with (per)fluorophosphonyl halides (see preparations described above for compounds of formula (3)) and (per)fluorosulfonyl halides (known in the art), respectively, to produce the conjugate acids of anions of formula (31). The corresponding erosion inhibitor compounds can be prepared by preparing the desired salt of the appropriate conjugate acid precursor using conventional methods.

The erosion inhibitor compound anions of formula (32) can be prepared as follows. Where R" is H, the conjugate acids of formula (32) are described in U.S. Pat. No. 3,984,357, which is incorporated by reference herein in its entirety. Conjugate acids of anions of formula (32) wherein R" is alkyl can be prepared by generating the anion of formula (32) wherein R" is H, and reacting the anion with an alkyl halide, as described above for conjugate acids of anions of formulae (27), (28) or (29). Conjugate acids of anions of formula (32) wherein R" is aryl can be prepared as follows: $R_fSO_2CH_2Ar$ is prepared as described in WO 02/48098. The anion of this sulfonylmethane is generated with base and reacted with $R_fCOCl$, which is well known, to produce the conjugate acids of anions of formula (32) wherein R" is aryl. The corresponding erosion inhibitor compounds can be prepared by preparing the desired salt of the appropriate conjugate acid precursor using conventional methods.

The erosion inhibitor compound anions of formula (33) can be prepared as follows. The preparation of (per)fluoroalkylsulfonylmethanes and their corresponding anionic methides are known. Such methides can then be reacted with (per)fluoroalkyl-phosphonyl halides (preparation described herein in the description of the preparation of the compounds of formula (3) where B=OR, and the preparation of the compounds of formula (4) where B=NRR') to produce the conjugate acids of anions of formula (33). The corresponding erosion inhibitor compounds can be prepared by preparing the desired salt of the appropriate conjugate acid precursor using conventional methods.

The erosion inhibitor compound anions of formula (34) can be prepared as follows. The trisulfide (CAS 691-69-0)

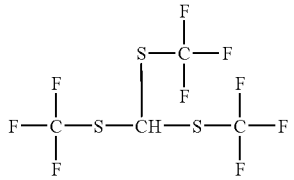

is known. Controlled oxidation of fluoroalkylsulfides to the corresponding sulfoxides would produce a conjugate acid of an anion of formula (34) and is known in the art. Alternatively, the halides $R_fS(=O)F$ can be reacted with MeLi or MeMgBr, the methide anion regenerated with further base and reacted with additional $R_fS(=O)F$, twice, to construct the tris(alkylsulfoxy)methane compound of formula (34). The corresponding erosion inhibitor compounds can be prepared by preparing the desired salt of the appropriate conjugate acid precursor using conventional methods.

The erosion inhibitor compound anions of formula (35) can be prepared as follows. The compound $F_3C—S(=O)NH_2$ is known and can be prepared by reacting $F_3C—S(=O)F$ with ammonia. Utilizing proper stoichiometry, one skilled in the art may be able to force the formation of $R_fS(=O)NHS(=O)R_f$. In the alternative, the amide anion of $F_3C—S(=O)NH_2$ can be generated with strong base, and reacted with a second equivalent of $R_fS(=O)F$ to produce the desired conjugate acid of the anion of formula (35). The corresponding erosion inhibitor compounds can be prepared by preparing the desired salt of the appropriate conjugate acid precursor using conventional methods.

The erosion inhibitor compound anions of formula (36) can be prepared as follows. The intermediate compounds $R_f—S(=O)—X$ wherein X is halogen are known. The sulfinyl halide can be reacted with alkyl or aralkyl anion (Grignard or lithium reagent) to form $R_f—S(=O)—CH2R'$. The methide anion can be regenerated with suitable base and reaction of the methide anion with a second mole of sulfinyl halide will produce the conjugate acid of formula (36). The corresponding erosion inhibitor compounds can be prepared by preparing the desired salt of the appropriate conjugate acid precursor using conventional methods.

The erosion inhibitor compound anions of formula (38) can be prepared as follows. Alpha, omega bis(pentafluorosulfides) are known, e.g. CAS 51658-19-

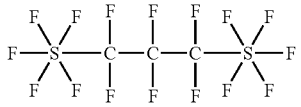

with a general preparation method described in: *Electrochemical fluorination of dithiols and cyclic sulfides*, Abe, Takashi; Nagase, Shunji; Baba, Hajime, Bull. Chem. Soc. Jap. (1973), 46 (12), 3845-8 (CAN 80:103155). Reaction of theses compounds with primary amines, R'NH2 (four moles per mole of bis(pentafluorothia)alkylene), will produce:

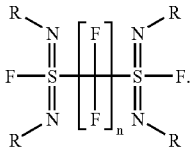

This compound can then subsequently be reacted with one mole of ammonia to afford the cyclic compound, the desired conjugate acid of the anion of formula (38). The corresponding erosion inhibitor compounds can be prepared by preparing the desired salt of the appropriate conjugate acid precursor using conventional methods.

The following alpha, omega bis(alkyl halophosphino) alkane precursors are used for the preparation of the erosion inhibitor compounds of formulae (39) and (40). Some forms of $ClP(R)—[CH_2]_n—P(R)Cl$ are known. Otherwise, they can be prepared from alpha, omega alkylene dihalides by a three-step process: (1) form the bis magnesium halide from the dihalide, (2) react this with alkyl (dialkylamino)phosphorus chloride $R(R'_2N)PCl$ to form $R_2NP(R')—R''—P(R')NR_2$, and (3) react the aminophosphine with PCl3 to generate the halophosphine $ClP(R)—[CH_2]_n—P(R)Cl$ (see Dienert, Klaus, et al., Phosphorus Sulfur (1983), 15 (2), 155-64 (CAN 99:105355)). Such unfluorinated precursors could be converted to the (per)fluorinated analogs by electrochemical fluorination, a conventional technique of wide use in the art. Reaction with fluorine or chlorine will convert the trivalent phosphorus atoms to pentavalent phosphorus atoms, affording $ClX_2P(R_f)—[CF_2]_n—P(R_f)X_2Cl$.

The erosion inhibitor compound anions of formula (39) can be prepared as follows. Careful reaction of $ClX_2P(R_f)—[CF_2]_n—P(R_f)X_2Cl$ with a single mole of ammonia will produce the cyclic phosphinimide, which can then be carefully hydrolyzed with two moles of water to produce the conjugate acids of anions of formula (39). Alternatively, if $ClP(R_f)—[CF_2]_n—P(R_f)Cl$ is obtained from the electrochemical fluorination, without oxidation to pentavalent phosphorus, then this compound could be reacted with a single mole of ammonia to produce the cyclic imide, which would then be reacted with hydrogen peroxide to produce the conjugate acids of anions of formula (39). The corresponding erosion inhibitor compounds can be prepared by preparing the desired salt of the appropriate conjugate acid precursor using conventional methods.

The erosion inhibitor compound anions of formula (40) can be prepared as follows. Use oxidative halogenation, if necessary, to obtain the pentavalent phosphorus compound $ClX_2P(R_f)—[CF_2]_n—P(R_f)X_2Cl$. Reaction thereof with a single mole of ammonia, followed by further ammonia, or primary amines $RNH_2$ will produce conjugate acids of anions of formula (40), wherein R is H in the former case, and R is (substituted) alkyl in the latter. The corresponding erosion inhibitor compounds can be prepared by preparing the desired salt of the appropriate conjugate acid precursor using conventional methods.

The erosion inhibitor compound anions of formula (41) can be prepared as follows. Perfluorobisphosphonates, such as the following are known, and can serve as precursors to materials of formula (41):

CAS 156628-86-3

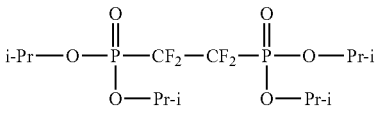

CAS 147860-30-8

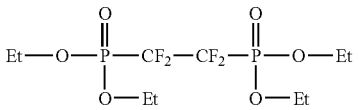

The preparation of the bisphosphonates is described in: *A new synthetic route to perfluoroalkylidene-α,ω-bisphosphonates*, Nair, Haridasan K.; Burton, Donald J., Tetrahedron Letters (1995), 36(3), 347-50, (CAN 122:187672). It is known from *DiaLkyl trifluoromethyl phosphonates*, Maslennikov, I. G.; Lavrent'ev, A. N.; Lyubimova, M. V.; Shvedova, Yu. I.; Lebedev, V. B., Leningr. Tekhnol. Inst., Leningrad, USSR, Zh. Obshch. Khim. (1983), 53(12), 2681-4, (CAN 100:121230) that $R_f—P(OR)_2$ reacts with chlorine to afford $R_f—P(=O)(OR)Cl$. Thus, treatment of the above bis(phosphonites) with chlorine will yield $[Cl—P(=O)(OR)]—R_f—[P(=O)(OR)—Cl$. This material will react with ammonia to yield the cyclic imide, the conjugate acid of the anion of formula (41). The corresponding erosion inhibitor compounds can be prepared by preparing the desired salt of the appropriate conjugate acid precursor using conventional methods.

The following alpha, omega bis(dihalophosphino)alkane precursors are used for the preparation of the erosion inhibitor compounds of formulae (42), (43) and (44). For the special case of 1,2-bis(dihalophosphino)perfluoroalkanes, tetrafluorodiphosphine has been found to add across double bonds: *Photoreactions of tetrafluorodiphosphine with non-substituted olefins and perfluoroolefins*, Morse, Joseph G.; Morse, Karen W., Inorg. Chem. (1975), 14(3), 565-9, (CAN 82:105840).

CAS 53432-53-4

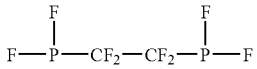

Otherwise, other compounds of general structure $X_2P—R—PX_2$ are known, or can be made by the formation of $(R_2N)_2P—R'—P(NR_2)_2$ from reaction of $(R_2N)_2PCl$ with alpha, omega alkylenebis(magnesium bromide) Grignards, followed by the reaction of the aminophosphine with $PCl_3$. Such unfluorinated materials can be electrochemically fluorinated by conventional techniques.

The erosion inhibitor compound anions of formula (42) can be prepared as follows. Precursor material $Cl_2P[CH_2]_nPCl_2$ is electrochemically and oxidatively fluorinated, and the product $F_2Cl_2P[CF_2]_nPCl_2F_2$ reacted first with a single mole of ammonia to cyclize the molecule. Then reaction with two moles of alcohol, ROH, will produce a mixture, one component of which will be

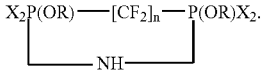

Treatment of this material with ammonia will produce materials of formula (42) wherein NR═NH. Reaction with a primary amine instead of ammonia will produce conjugate acids of anions of formula (42) wherein R is (substituted) alkyl. The corresponding erosion inhibitor compounds can be prepared by preparing the desired salt of the appropriate conjugate acid precursor using conventional methods.

The erosion inhibitor compound anions of formula (43) can be prepared as follows. Fluorinated materials $Cl_2P—[CF_2]_n—PCl_2$ can be reacted with ammonia and then ammonia or primary amines, followed by oxidation with hydrogen peroxide or peracetic acid. $Cl_2P—[CH_2]_nPCl_2$ can be electrochemically fluorinated, and will yield either $Cl_2P—[CF_2]_n—PCl_2$ or $Cl_2F_2P—[CF_2]_n—PF_2Cl_2$. If perfluorination oxidative, producing the latter, then instead of an oxidation step, a hydrolysis step is employed. The corresponding erosion inhibitor compounds can be prepared by preparing the desired salt of the appropriate conjugate acid precursor using conventional methods.

The erosion inhibitor compound anions of formula (44) can be prepared as follows. Precursor material $Cl_2P—[CH_2]_n—PCl_2$ is electrochemically and oxidatively fluorinated to ensure production of $F_2Cl_2P—[CF_2]_n—PCl_2F_2$, and this reacted with ammonia to produce conjugate acids of anions of formula (44) wherein R and R'═H. Alternatively, careful treatment with a single mole of ammonia, followed by primary amines will lead to conjugate acids of anions of formula (44) wherein R is (substituted) alkyl, and R' is H. A three-step treatment with ammonia, primary amine, and lastly secondary amine will lead to conjugate acids of anions of formula (44) wherein R and R' are (substituted) alkyl. The corresponding erosion inhibitor compounds can be prepared by preparing the desired salt of the appropriate conjugate acid precursor using conventional methods.

The erosion inhibitor compound anions of formula (45) can be prepared as follows. The following exemplary cyclic imides are known: $R_{f3}=C_2F_4$, CAS 377-33-3; and $R_{f3}=C_3F_6$, CAS 376-67-0. The compounds can be prepared by the method described in: *Interaction of cyclic anhydrides of perfluorodicarboxylic acids with nucleophilic agents*, Sankina, L. V.; Kostikin, L. I.; Ginsburg, V. A. USSR, Zh. Org. Khim. (1972), 8(6), 1330-1, (CAN 77:125910). The corresponding erosion inhibitor compounds can be prepared by preparing the desired salt of the appropriate conjugate acid precursor using conventional methods.

The erosion inhibitor compound anions of formula (46) can be prepared as follows. The following exemplary cyclic imides are known: $R_f=C_2F_4$ and $R_f=C_3F_6$, wherein R is H. U.S. Pat. No. 3,041,346 (Kober, Raetz and Ulrich; Olin Mathieson Chem Corp.) describes the preparation of monomeric materials of the following formula:

(46b)

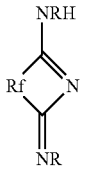

which is simply a tautomer of (46c)

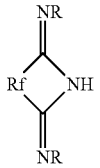

U.S. Pat. No. 3,041,346 is cited in U.S. Pat. No. 3,269,959 (Kober, Raetz and Ulrich; Olin Mathieson Chem Corp.) describing similar compounds as precursors to polymers. U.S. Pat. Nos. 3,041,346 and 3,269,959 are incorporated by reference herein in their entirety. The corresponding erosion inhibitor compounds, containing anions of formula (46), can be prepared by preparing the desired salt of the appropriate conjugate acid precursor using conventional methods.

The erosion inhibitor compound anions of formula (47) can be prepared as follows. Unfluorinated compounds are known and their preparation illustrates the use of bissulfonyl methide anion reacting with sulfonyl chloride to yield a trissulfonylmethane.

CAS 128373-39-7

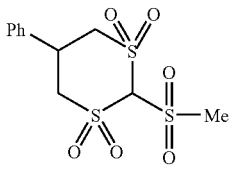

See *Alkylation of* 1,3-*dithiane* 1,1,3,3-*tetroxide derivatives*, Bazavova, I. M.; Esipenko, A. N.; Neplyuev, V. M.; Lozinskii, M. O. Inst. Org. Khim., Kiev, USSR, Ukr. Khim. Zh. (Russ. Ed.) (1989), 55(11), 1216-19, (CAN 113:59058). Thus, perfluoroalkylene-bissulfonylmethanes (formula (51), $R_f$=H) can be treated with base and reacted with perfluoroalkanesulfonyl halides (known and commercially available) to produce conjugate acids of anions of formula (47). Alternatively, (per)fluoroalkylenebissulfonylhalides are known, as are (per)fluoroalkylsulfonylmethanes. Furthermore, preparation of the methide anion of the latter is known. Reaction of this anion with the bissulfonylhalides, followed by regeneration of the methide anion would lead to the cyclic (per)fluoro-tris(sulfonyl)methides. The corresponding erosion inhibitor compounds can be prepared by preparing the desired salt of the appropriate conjugate acid precursor using conventional methods.

The erosion inhibitor compound anions of formula (48) can be prepared as follows. It is known from *Dialkyl trifluoromethyl phosphonates*, Maslennikov, I. G.; Lavrent'ev, A. N.; Lyubimova, M. V.; Shvedova, Yu. I.; Lebedev, V. B., Leningr. Tekhnol. Inst., Leningrad, USSR, Zh. Obshch. Khim. (1983), 53(12), 2681-4, (CAN 100: 121230) that $R_f$—$P(OR)_2$ reacts with chlorine to produce $R_f$—P(=O)(OR)Cl, the (per)fluoroalkylphosphonyl halide precursor. The other precursor, i.e. cyclic alkylenebisphosphonomethanes, are discussed below for the preparation of materials of formula (52), albeit not fluorinated. A method by which to produce fluorinated analogs wherein the carbon at the 2-position remains unfluorinated is described in the preparation of the materials of formula (52). This can be used as a precursor here, by generating the methide anion via treatment with strong base, e.g. t-butyllithium, and subsequently reacting the anion with the alkylphosphonyl halide, the conjugate acid of an anion of formula (48) will be produced. The corresponding erosion inhibitor compounds can be prepared by preparing the desired salt of the appropriate conjugate acid precursor using conventional methods.

The erosion inhibitor compound anions of formula (49) can be prepared as follows. The cyclic (per)fluoroalkylenebissulfonylmethanes are known (as discussed below for formula (51)), and (per)fluorocarboxylic acid chlorides are well-known and available. Treatment of the cyclic bissulfonylmethane with base to form the methide anion, followed by its reaction with the acid chloride will afford a conjugate acid of an anion of formula (49). The corresponding erosion inhibitor compounds can be prepared by preparing the desired salt of the appropriate conjugate acid precursor using conventional methods.

The erosion inhibitor compound anions of formula (50) can be prepared as follows. The following exemplary compounds are known: $R_{f3}=C_3F_6$ and $C_2F_4$, with $R_f=CF_3$ or $C_2F_5$ with the former, and $C_5F_7$ (cyclopentenyl) for the latter. A method applicable for preparation of the erosion inhibitor compound anions of formula (50) is taught from the following references: *Reactions of perfluoro*-1-*alkylcycloalkenes with alcohols and the properties of the vinyl ether products*, Snegirev, V. F.; Makarov, K N., Izv. Akad. Nauk SSSR, Ser. Khim. (1986), (6), 1331-40, (CAN 107:6794), e.g. hydrolysis of the compounds of formula IV in the reference, and *Reactions involving fluoride ion. Part* 39. *Reactions of perfluorinated dienes with oxygen and sulfur nucleophiles*, Briscoe, Mark W.; Chambers, Richard D.; Mullins, Steven J.; Nakamura, Takayuki; Vaughan, Julian F. S., Journal of the Chemical Society, Perkin Transactions 1: Organic and Bio-Organic Chemistry (1994), (21), 3119-24, (CAN 123:143308), e.g. hydrolysis of compounds of formulae II and III in the reference. The corresponding erosion inhibitor compounds can be prepared by preparing the desired salt of the appropriate conjugate acid precursor using conventional methods.

The erosion inhibitor compound anions of formula (51) can be prepared as follows. The following exemplary compounds of formual (51) are known: $R_{f3}=C_2F_4$ or $C_3F_6$, and $R_f$ is a nonfluorinated alkyl group.

CAS 211696-08-1

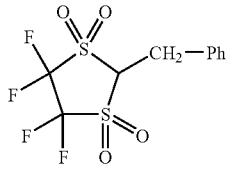

CAS 161944-41-8

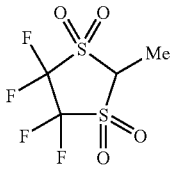

CAS 161944-35-0

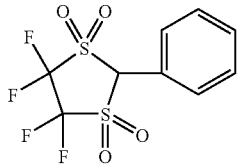

A method applicable for preparation of the erosion inhibitor compound anions of formula (51) is taught from the following references: *Chemical transformation of bis((perfluoroalkyl)sulfonyl)methanes and* 1,1,3,3-*tetraoxopolyfluoro*-1,3-*dithiacycloalkanes*, Zhu, Shizheng; Xu, Guoling; Qin, Chaoyue; Yong, Xu; Qianli, Chu; DesMarteau, Darryl D., Shanghai Institute of Organic Chemistry, Chinese Academy of Sciences, Shaghai, Peop. Rep. China, Heteroatom Chemistry (1999), 10(2), 147-152, (CAN 130:338073), and 1,1,3,3-*Tetraoxopolyfluoro*-1,3-*dithiacycloalkanes. CH2SO2(CF2)nSO2* (*n*=2-5) *and* 2-*Substituted Derivatives*, Zhu, Shi-Zheng; Pennington, William T.; DesMarteau, Darryl D., Chemistry Department, Clemson University, Clemson, S.C., USA, Inorganic Chemistry (1995), 34(4), 792-5, (CAN 122:214019). The corresponding erosion inhibitor compounds can be prepared by preparing the desired salt of the appropriate conjugate acid precursor using conventional methods.

The erosion inhibitor compound anions of formula (52) can be prepared as follows. Unfluorinated compounds similar to the compounds of formula (52) wherein $R_f$=H are known:

CAS 65617-64-3

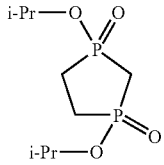

-continued

CAS 65617-65-4

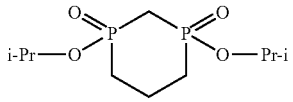

CAS 65617-66-5

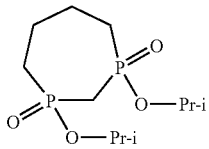

The preparation of these compounds is described in: *Synthesis of* 1,3-*di*(*oxoalkoxy-phospha*)*cycloalkanes*, Novikova, Z. S.; Prishchenko, A. A.; Lutsenko, I. F., Mosk. Gos. Univ., Moscow, USSR, Zh. Obshch. Khim. (1977), 47(11), 2636-7, (CAN 88:89769). Thus, one of ordinary skill can react the known and commercially available perfluorodihalides $X(CF_2)_2X$ (wherein X is Cl, Br or I, available from several sources, including Alfa-Aesar, ACBR and Matrix Scientific) with $CH_2[P(OR)_2]_2$ under the conditions described in the cited reference, to produce fluorinated cyclic 1,3-di(oxo-alkoxyphospha)cycloalkanes wherein C-2 of the ring is —$CH_2$—. The methide anion can subsequently be formed by reaction with a suitably strong base. If desired, this methide anion can then be reacted with $R_fX$ to create substances of formula (52) wherein $R_f$ is not H. The corresponding erosion inhibitor compounds can be prepared by preparing the desired salt of the appropriate conjugate acid precursor using conventional methods.

In a preferred embodiment, the present invention is directed to a functional fluid composition suitable for use as an aircraft hydraulic fluid. Illustratively, the compounds of this invention may be suitably employed as the erosion inhibitor(s) in compositions disclosed in U.S. Pat. Nos. 5,464,551, 6,319,423, and 6,391,225, which are incorporated herein by reference in their entirety.

The phosphate esters suitable for use in the basestock of the functional fluids of the invention are trialkyl phosphates, triaryl phosphates, dialkyl aryl phosphates, alkyl diaryl phosphates, and mixtures thereof.

The alkyl substituents of the phosphate esters of the invention are $C_3$ to $C_8$, preferably $C_4$ to $C_5$. Preferably, the alkyl substituents are selected from n-butyl, isobutyl, n-pentyl or isopentyl, more preferably n-butyl and isobutyl. In the trialkyl phosphates, the three alkyl substituents can be the same or different and mixtures of trialkyl phosphates can be used. Examples of trialkyl phosphates include, but are not limited to, triisobutyl phosphate, tri-n-butyl phosphate, tri (isobutyl/n-butyl) phosphate, tri(isopentyl) phosphate, tri(n-pentyl) phosphate, and mixtures thereof. Mixtures of trialkyl phosphates include mixtures of triisobutyl phosphate and tri-n-butyl phosphate, such as taught in U.S. Pat. No. 6,319,423. In the dialkyl aryl phosphates, the two alkyl substituents can be the same or different and mixtures of dialkyl aryl phosphates can be used.

The aryl substituents of the phosphate esters of the invention are typically phenyl, but may also be an alkyl-substituted phenyl (alkylphenyl) wherein the alkyl substituent is $C_1$ to $C_9$, preferably $C_3$ to $C_4$. Nonlimiting examples of the alkyl-substituted phenyl substituents include, but are not limited to, tolyl (also known as methylphenyl), ethylphenyl, isopropylphenyl, isobutylphenyl, tert-butylphenyl, and the like. Examples of triaryl phosphates include, but are not limited to, triphenyl phosphate, tri(t-butylphenyl) phosphate, tri(isopropylphenyl) phosphate, and mixtures thereof. In the triaryl phosphates and alkyl diaryl phosphates, the aryl substituents can be the same or different and mixtures of alkyl diaryl phosphates and/or triaryl phosphates can be used.

Exemplary phosphate ester basestocks include, but are not limited to, basestocks comprising between about 20% to about 100%, preferably about 50% to about 99%, by weight of trialkyl phosphate, between 0% and about 40%, preferably 0% to about 35%, by weight of dialkyl aryl phosphate, between 0% and about 20%, preferably 0% to about 5%, by weight of alkyl diaryl phosphate, and between 0% and about 20%, preferably 0% to about 15%, by weight of triaryl phosphate.

The functional fluids of the invention optionally contain other components such as antioxidants, viscosity index (VI) improvers, acid scavenger additives, corrosion inhibitors, and anti-foam agents.

To limit the effect of temperature on viscosity, the composition may include a polymeric viscosity index improver. Preferably, the viscosity index improver comprises a poly (alkyl methacrylate) ester of the type described in U.S. Pat. No. 3,718,596 having the molecular weight set forth herein. Generally, the viscosity index improver is of high molecular weight, having a number average molecular weight of between about 30,000 and about 100,000 and a weight average molecular weight of between about 60,000 and about 300,000. Preferably, the viscosity index improver of the invention has a relatively narrow range of molecular weight, approximately 95% by weight of the viscosity index improver component having a molecular weight of between about 50,000 and about 1,500,000. The viscosity index improver is present in a proportion sufficient to impart the desired kinematic viscosity. Superior shear stability characteristics are also imparted by the viscosity index improver used in the composition. Preferably the functional fluid composition contains between about 3% and about 10% by weight of the viscosity index improver. An example of a particularly preferred viscosity index improver is sold under the trade designation Acryloid® 4495 available from Rohmax USA, Inc. The viscosity index improver is conveniently provided in the form of a solution in a phosphate ester solvent, preferably a trialkyl phosphate ester such as tributyl or triisobutyl phosphate, or a combination of alkyl and phenyl derivatives. The proportions referred to above for the viscosity index improver are on a solids (methacrylate polymer) basis. The phosphate ester solvent becomes in effect part of the basestock, and the ranges of proportions of phosphate esters, as discussed above, reflect the phosphate ester added as a vehicle for the viscosity index improver.

The composition of the invention may include an acid scavenger in a proportion sufficient to neutralize phosphoric acid and phosphoric acid partial esters formed in situ by decomposition of components of the phosphate ester base stock under conditions of the service in which the hydraulic fluid composition is used. Preferably, the acid scavenger of the functional fluid of the present invention is a 3,4-epoxycyclohexane carboxylate composition of the type described in U.S. Pat. No. 3,723,320 or epoxide compounds of the type described in U.S. Patent Application Pub. No. US 2002/0033478 A1, both of which are incorporated herein by reference in their entirety. Examples of suitable epoxides of U.S. Patent Application Pub. No. US 2002/0033478 A1include, but are not limited to, trimethoxy 2-(7-oxabicyclo[4.1.0]hept-3-yl)ethylsilane ("TMOE"), exo-2,3-epoxynorbornane ("ENB"), 3-benzyloxymethyl-7-oxabicyclo [4.1.0]heptane ("BOCH"), 3-decyloxymethyl-7-oxabicyclo [4.1.0]heptane ("DOCH"), 3-n-butoxyethoxymethyl-7-oxabicyclo[4.1.0]heptane ("BEOCH"), 3-(5,5-dimethyl-2-oxo-1,3,2-dioxaphosphorinanoxymethyl)-7-oxabicyclo [4.1.0] ("DODOH"), 3-(2-ethylhexyl-oxymethyl)-7-oxabicyclo[4.1.0]heptane ("EOH"), 1-(7-oxabicyclo-[4.1.0] hept-3-yl)-1-hexanone ("KHOH"), 1-(7-oxabicyclo[4.1.0] hept-3-yl)-1-phenone ("KPOH"), 4-methyl-3-hexyloxymethyl-7-oxabicyclo[4.1.0]heptane ("MHOCH"), 3-(phenylmethyl)-7-oxabicyclo[4.1.0]heptane ("BOBH"), 5-n-octyloxymethyl-3-oxatricyclo[3.2.1.02,4]octane ("OMOO"), mixtures thereof and the like. An example of a suitable epoxide of U.S. Pat. No. 3,723,320 is 2-ethylhexyl 3,4-epoxycyclohexane carboxylate, an acid scavenger used in current commercial aircraft hydraulic fluid compositions. The concentration of the acid scavenger in the fluid composition is preferably between about 1.5% and about 10%, more preferably between about 2% and about 8% by weight, which is generally sufficient to maintain the hydraulic fluid in a serviceable condition for up to approximately 3000 hours of aircraft operation.

The composition of the invention may also contain at least one antioxidant additive selected from amine antioxidants, hindered phenols and hindered polyphenols. The antioxidant is preferably a combination of antioxidants selected from amine antioxidants, hindered phenols and hindered polyphenols, more preferably a combination of an amine antioxidant and at least one of a hindered phenol and/or a hindered polyphenol, and most preferably a combination of an amine antioxidant, a hindered phenol, and a hindered polyphenol. When a hindered phenol is used, it is generally preferred that the composition contain between about 0.1% and about 0.7% of a 2,4,6-trialkylphenol, preferably 2,6-di-tertiary-butyl-p-cresol [also written as 2,6-di-tert-butyl-p-cresol or 2,6-di-t-butyl-p-cresol ("Ionol")]. When a hindered polyphenol is used, the composition preferably includes between about 0.3% and about 1% of a hindered polyphenol compound, such as a bis(3,5-dialkyl-4-hydroxyaryl) methane, for example, the bis(3,5-di-tert-butyl-4-hydroxyphenyl) methane sold under the trade designation Ethanox® 702 by the Albemarle Corp., a 1,3,5-trialkyl-2,4,6-tris(3,5-dialkyl-4-hydroxyaryl) aromatic compound, for example, the 1,3,5-trimethyl-2,4,6-tris(3,5-di-tert-butyl-4-hydroxyphenyl)benzene sold under the trade designation Ethanox® 330 by the Albemarle Corp., or mixtures thereof. The composition may include an amine antioxidant, preferably a diarylamine such as, for example, phenyl-alpha-napthylamine or alkylphenyl-alpha-naphthylamine, or the reaction product of N-phenylbenzylamine with 2,4,4-trimethylpentene sold under the trade designation Irganox® L-57 by Ciba-Geigy; diphenylamine, ditolylamine, phenyl tolylamine, 4,4'-diaminodiphenylamine, di-p-methoxydiphenylamine, or 4-cyclohexylaminodiphenylamine; a carbazole compound such as N-methylcarbazole, N-ethyl-carbazole, or 3-hydroxycarbazole; an aminophenol such a N-butylaminophenol, N-methyl-N-amylaminophenol, or N-isooctyl-p-aminophenol; an aminodiphenyl-alkane such as aminodiphenylmethanes, 4,4'-diamino-diphenylmethane, etc., aminodiphenylethers; aminodiphenyl thioethers; aryl substituted alkylenediamines such as 1,2-di-o-toluidoethane, 1,2-dianilinoethane, or 1,2-dianilino-propane; aminobiphenyls, such as 5-hydroxy-2-aminobiphenyl, etc.; the reaction product of an aldehyde or ketone with an amine such as the reaction product of acetone and diphenylamine; the reaction product of a complex diarylamine and a ketone or aldehyde; a morpholine such as N-(p-hydroxy-phenyl)morpholine, etc.; an amidine such as N,N'-bis-(hydroxyphenyl)-acetamidine or the like; an acridan such as 9,9'-dimethyl-acridan, a phenathiazine such as phenathiazine, 3,7-dibutylphenathiazine or 6,6-dioctylphenathiazine; a cyclohexylamine; or mixtures thereof. An alkyl substituted diphenylamine such as di(p-octylphenyl) amine is preferred. Certain amine components can also act as a lubricating additive. The amine antioxidant, when used, is also preferably present in a proportion of between about 0.3 and about 1% by weight, preferably between about 0.3 and 0.7% by weight, and more preferably between about 0.3 and 0.5% by weight.

The functional fluids of the invention may contain a copper corrosion inhibitor. This corrosion inhibitor is present in an amount sufficient to deactivate metal surfaces in contact with the fluid composition against the formation of metal oxides on the metal surfaces in contact with the fluid, thereby reducing rates of copper dissolution into the hydraulic fluid, and also reducing dissolution of perhaps parts fabricated from copper alloys. Advantageously, the functional fluids of the invention contains between about 0.005% and about 1.0% by weight of the copper corrosion inhibitor.

Phosphate ester functional fluids are known to corrode iron alloys as well as copper alloys. Numerous iron corrosion inhibitors are available for use in functional fluids, but these are known in many instances to increase rates of erosion and thus have a net deleterious effect on the performance properties of the hydraulic fluid. However, certain 4,5-dihydroimidazole compounds are effective iron corrosion inhibitors that do not adversely affect the erosion properties of the fluid. Useful 4,5-dihydroimidazole compounds include those that correspond to the structural formula

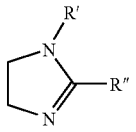

where R' is hydrogen, alkyl, alkenyl, hydroxyalkyl, hydroxyalkenyl, alkoxyalkyl or alkoxyalkenyl, and R" is alkyl, alkenyl or an aliphatic carboxylate. Exemplary groups that may constitute R' include hydrogen, methyl, ethyl, propyl, butyl, pentyl, octyl, vinyl, propenyl, octenyl, hexenyl, hydroxyethyl, hydroxyhexyl, methoxypropyl, propoxyethyl, butoxypropenyl, etc. Exemplary group, which may constitute R" include, octyl, dodecyl, hexadecyl, heptadecenyl, or a fatty acid substituent such as 8-carboxyoctyl, 12-carboxydodecyl, 16-carboxyhexadecenyl, or 18-carboxyoctadecyl. In a particularly effective embodiment, R' is hydrogen or lower alkyl and R" is a fatty acid residue containing at least about 9 carbon atoms, i.e., —$C_8$—COOH to —$C_{18}$COOH, preferably $C_{16}$—COOH to $C_{18}$—COOH. In another preferred embodiment, R' is a lower hydroxyalkyl and R" is a $C_8$-$C_{18}$ alkenyl. In the latter instance, however, the most satisfactory inhibition of Fe corrosion is realized only if the 4,5-dihydro-imidazole is used in combination with an amino acid derivative, more particularly an N-substituted amino acid in which the N-substituent contains both polar and oleophilic moieties, for example, an N-alkyl-N-oxo-alkenyl amino acid.

A suitable iron corrosion inhibitor is the condensation product of 4,5-dihydro-1H-imidazole and C16-C18 fatty acid (sold under the trade designation Vanlube RI-G by the Vanderbilt Co.). Also effective as a 4,5-dihydroimidazole compound is 2-(8-heptadecenyl)-4,5-dihydro-1H-imidazole-1-ethanol (sold under the trade designation Amine-O by Ciba-Geigy). To function as an iron corrosion inhibitor, the latter compound should be used in combination with an amino acid derivative such as, e.g., the N-methyl-N-(1-oxo-9-octadecenyl)glycine sold under the trade designation Sarkosyl®-O by Ciba-Geigy Corporation.

Other iron corrosion inhibitors known to those skilled in the art have also been found effective in the functional fluids of the invention without adverse effect on erosion characteristics.

As necessary, the functional fluids of the invention may also contain an anti-foaming agent. Preferably, this is a silicone fluid, more preferably a polyalkylsiloxane, for example, the polymethylsiloxane sold under the trade designation DC 200 by Dow Corning. Preferably the anti-foam agent is included in a proportion sufficient to inhibit foam formation under the test conditions of ASTM method 892. Typically, the anti-foam content of the composition is at least about 0.0005% by weight, typically about 0.0001% to about 0.001% by weight.

EXAMPLES

The following examples illustrate the testing of the erosion inhibitors of the invention compared against the erosion inhibitor used in commercial phosphate ester aviation hydraulic fluid, i.e. Fluorad™ FC-98 of 3M Company which is a mixture of a potassium salt of perfluoroethyl cyclohexyl sulfonate, a potassium salt of perfluoromethyl cyclohexyl sulfonate, a potassium salt of perfluorodimethyl cyclohexyl sulfonate, and a potassium salt of perfluorocyclohexyl sulfonate.

The fluid formulation used for the examples, which included a phosphate ester base stock and typical additive components to which each anti-erosion candidate was added, was blended in the laboratory to have a composition typical of commercial airline hydraulic fluid. The base stock composition was about 57% tributyl phosphate, 23% dibutyl phenyl phosphate, 6% butyl diphenyl phosphate with the balance being made up with components such as a viscosity index improver, acid scavenger, anti-oxidant, corrosion inhibitor, dye, and antifoam agent. These components were all available commercially. All samples were spiked to contain 0.2% water. The anti-erosion additive candidate to be tested was added to the above fluid formulation.

Needle-To-Plane Device/Method: The needle-to-plane apparatus is an experimental device that uses an applied voltage to simulate the streaming potential that might be established under the high flow conditions in aircraft hydraulic servo-valves. The concept is that the external power source serves the same function as the velocity as the driving force to create a polarization of the surface that results in pitting, metal loss, and subsequent increased leakage in the servo valves. The streaming current that induces this streaming potential and subsequent polarization was proposed to be the cause of valve erosion by T. R. Beck, "Wear of Small Orifices by Streaming Current Driven Corrosion", Transactions of ASME, Journal of Basic Engineering, Vol. 92, p. 782 (1970). The goal of the experimental use of the needle-to-plane technique is to determine the maximum current at which pitting begins to occur. That current is labeled the threshold current. It is theorized that the greater the current at which pitting begins to occur, the greater the ability of the fluid to protect the servo valve surface from being eroded. Appropriate fluid additives impart this inhibition capability.

The needle-to-plane device is described in detail in the above report as well as in "Pitting and Deposits with an Organic Fluid by Electrolysis and by Fluid Flow", T. R. Beck, et al., J. Electrochem. Soc., Vol. 119, p. 155 (1972). In this device, a steel phonograph needle is held in close proximity to a flat surface made from an appropriate steel alloy. In this case, 440C was chosen. The separation between the needle and plane was 0.01" as measured by the micrometer head holding the needle. Enough test fluid was placed into the vessel so that the flat steel surface and the tapered portion of the needle are immersed. The experiment as practiced in the examples was as follows. The surface was finished using 600 grit silicon carbide paper. The needle and plane were mounted appropriately and the fluid introduced. A voltage was applied for 10 minutes. At the end of that time, the specimen forming the plane was removed and the surface was examined under an optical microscope for pits. If no pits were observed, the specimen was mounted in the device again, the distance reset, and a suitably chosen higher voltage applied for ten minutes. The steps were repeated until pits were observed under the optical microscope. The current at which pitting was observed was labeled the threshold current.

Example 1

Fluid solutions to which were added FC-98 at 250 ppm (50 micromole/100 gm) were tested in the needle-to-plane device as a control to provide a base-line for the needle-to-plane device. Since the FC-98 erosion inhibitor provides effective anti-erosion inhibition in hydraulic fluid, the assumption is that fluids that create threshold currents equal to or greater than those observed for the fluid solution outlined above and containing FC-98 would be suggestive of fluids that also effectively inhibit erosion. Thirty-three replicates were run in the needle-to-plane device. The mean threshold current was about 6.5 microamp with a standard deviation of 1.6 microamp and 2σ limits of 3.3 to 9.7 microamp. The maximum value in the 33 samples was 10.7 microamp and the minimum value was 3.7 microamp. Much of the variation can be attributed to specimen-to-specimen differences in surface finish and the ±5% to 10% error in reading the micrometer at these small distances. If the threshold current for the test fluid made with composition outlined above and containing the candidate anti-erosion additive is greater than the lower bound of the 2σ current range, 3.3 microamp, then that erosion inhibitor of the invention was concluded to be a promising anti-erosion additive.

The following erosion inhibitors of the invention were tested in the needle-to-plane device as described above. In most instances, only one sample of each compound was run. The results are provided in Table I.

TABLE I

THRESHOLD CURRENTS FOR EROSION INHIBITORS OF FORMULA (i)

| Erosion Inhibitor Compound | Concentration (Micromole/100 gm) | Threshold Current (Microamp) |
|---|---|---|
| Lithium bis(trifluoromethane sulfonyl) imide - added as salt | 50 | 9.8 |
| Lithium bis(trifluoromethane sulfonyl) imide - added as salt | 50 | 5.3 |
| Lithium bis(pentafluoroethane sulfonyl) imide - added as salt | 50 | 11.7 |
| Lithium bis(pentafluoroethane sulfonyl) imide - added as salt | 50 | 11.7 |
| Potassium bis(trifluoromethane sulfonyl) imide - added as salt | 25 | 6.5 |
| Potassium bis(trifluoromethane sulfonyl) imide - added as salt | 50 | 11.7 |
| Potassium bis(trifluoromethane) sulfonyl) imide - added as salt | 100 | 12.3 |
| Potassium bis(nonafluorobutane sulfonyl) imide - added as salt | 50 | 9.1 |
| Tetrabutyl ammonium bis(trifluoro-methane sulfonyl) imide - added as salt | 50 | 21.7 |
| Tetrabutyl ammonium bis(trifluoro-methane sulfonyl) imide - added as salt | 50 | 10.0 |
| Tetrabutyl ammonium bis(trifluoro-methane sulfonyl) imide - added as tetrabutyl ammonium hydroxide and trifluoromethane sulfonyl imide | 50 | 11.7 |
| Tetrabutyl ammonium bis(pentafluoro-ethane sulfonyl) imide - added as salt | 50 | 9.1 |
| Tetrabutyl ammonium bis(pentafluoro-ethane sulfonyl) imide - added as salt | 50 | 10.1 |
| Tetramethyl ammonium bis(penta-fluoroethane sulfonyl) imide - added as salt | 50 | 14.8 |
| Magnesium bis(pentafluoroethane sulfonyl) imide - added as salt | 50 | 6.8 |
| Calcium bis(pentafluoroethane sulfonyl) imide - added as salt | 50 | 4.0 |
| Calcium bis(pentafluoroethane sulfonyl) imide - added as salt | 50 | 3.1 to 4.5 |

TABLE I-continued

| THRESHOLD CURRENTS FOR EROSION INHIBITORS OF FORMULA (i) | | |
|---|---|---|
| Erosion Inhibitor Compound | Concentration (Micromole/100 gm) | Threshold Current (Microamp) |
| Lanthanum bis(pentafluoroethane sulfonyl) imide - added as salt | 50 | 9.8 |
| Lanthanum bis(pentafluoroethane sulfonyl) imide - added as salt | 50 | 8.3 |

The threshold current is given as a range in the second sample of calcium bis(pentafluoroethane sulfonyl) imidate because at a voltage of 11 volts the observed pits were extremely small whereas at the next applied voltage of 13 volts the observed pits were extremely large. The actual threshold current was somewhere between 3.1 and 4.5 microamps.

Table I shows the concentrations and threshold currents for the erosion inhibitors tested in the needle-to-plane device. As shown, the compounds were added as either the salt or made in-situ by adding the acid and base precursors from which the salt would form in the fluid. The needle-to-plane threshold current results demonstrate that the erosion inhibitors of formula (i) would be expected to be effective erosion inhibitors in phosphate ester-based hydraulic fluids.

Example 2

The needle-to-plane test of Example 1 was repeated to test erosion inhibitors of formulas (ii), (iii), (iv), (v) and (vi) and the results are presented in Table II.

TABLE II

| THRESHOLD CURRENTS FOR EROSION INHIBITORS OF FORMULAE (ii), (iii), (iv), (v) and (vi) | | |
|---|---|---|
| Erosion Inhibitor Compound | Concentration (Micromole/100 gm) | Threshold Current (Microamp) |
| Tetrabutyl ammonium bis(trifluoroacetyl) imide - added as salt | 50 | 4.9 |
| Tetrabutyl ammonium trifluoromethane sulfonamide - added as salt | 50 | 7.2 |
| Lithium trifluoromethane sulfonamidate - added as trifluoromethane sulfonamide and lithium hydroxide | 100 | 3.7 |
| Calcium dibenzene sulfonimidate (added as salt) | 50 | 3.8 |
| Tetrabutylammonium dibenzene sulfonimidate (added as salt) | 50 | 5.1 |
| Lithium dibenzene sulfonimidate (added as salt) | 50 | 3.9 |
| Cesium trifluoromethane sulfonamidate (added as salt) | 50 | 4.5 |
| Tetrabutyl ammonium hexafluoroacetyl acetone - added as salt | 50 | 5.2 |
| Tetrabutyl ammonium N—O bis(trifluoroacetate) hydroxylamine - added as salt | 50 | 6.3 |
| Tetrabutyl ammonium trans-N,N'-1,2-cyclohexane-diylbis (1,1,1-trifluoromethane-sulfonamidate) - added as tetrabutyl-ammonium hydroxide and as trans-N,N'-1,2-cyclohexanediylbis (1,1,1-trifluoromethane-sulfonamide) - salt formed in-situ | 100 | 6.1 |
| Lithium trans-N,N'-1,2-cyclohexanediylbis (1,1,1-trifluoromethanesulfonamidate), monolithium salt - added as equimolar lithium hydroxide and trans-N,N'-1,2-cyclohexanediylbis (1,1,1-trifluoromethane-sulfonamide) - salt formed in-situ | 100 | 5.2 |
| Lithium trans-N,N'-1,2-cyclohexanediylbis (1,1,1-trifluoromethanesulfonamidate), dilithium salt - added as 2x lithium hydroxide and trans-N,N'-1,2-cyclohexane-diylbis (1,1,1-trifluoromethane-sulfonamide) - salt formed in-situ | 100 | 5.6 |
| Lithium trifluoromethane sulfonamidate - added as salt | 100 | 3.7 |

The needle-to-plane threshold current results demonstrate that the erosion inhibitors of formula (ii), (iii), (iv), (v) and (vi) would be expected to be effective erosion inhibitors in phosphate ester-based hydraulic fluids.

Example 3

An erosion rig test was conducted on a fluid representative of commercial type IV phosphate ester hydraulic fluids containing lithium bis(trifluoromethane sulfonyl) imide as the erosion inhibitor at 10 and 50 micromole/100 gm concentrations according to the method set forth in Section 4.9, Flow Control Valve Life, of the Society of Automotive Engineers (SAE) Aerospace Standard AS1241, Fire Resistant Phosphate Ester Hydraulic Fluid for Aircraft, Revision C. The lithium bis(trifluoromethane sulfonyl) imide was shown to arrest erosion in the phosphate ester hydraulic fluid at both the 10 and 50 micromole/100 gm concentrations, i.e. both concentrations passed the erosion rig test. From the results in Tables I and II, one of ordinary skill in the art would expect other salts with the anion of formula (i) as well as the other erosion inhibitor compounds of the invention to be able to retard erosion as outlined by the requirements of Section 4.9. The results in Examples 1-3 also demonstrate the ability to use the needle-to-plane device as an effective predictor of effectiveness of erosion inhibitors in phosphate ester-based functional fluids.

Example 4

The fluids of Example 3 were tested in the needle-to-plane device both before and after the erosion rig test and the results are presented in Table III.

TABLE III

THRESHOLD CURRENTS FOR LITHIUM BIS(TRIFLUOROMETHANE SULFONYL) IMIDE IN EROSION RIG TEST

| Compound | Concentration (Micromole/100 gm) | Threshold Current (Microamp) |
|---|---|---|
| Lithium bis(trifluoromethane sulfonyl) imide - before erosion test | 50 | 7.7 |
| Lithium bis(trifluoromethane sulfonyl) imide - after erosion test | 50 | 6.6 |
| Lithium bis(trifluoroethane sulfonyl) imide - before erosion test | 10 | 4.9 |
| Lithium bis(pentafluoroethane sulfonyl) imide - after erosion test | 10 | 3.9 |

The results in Table III demonstrate that at 50 micromole/100 gm, the threshold current is at the higher end of the range found for commercial type IV phosphate ester hydraulic fluids. At 10 micromole/100 gm, the threshold current of the fluid is at the lower end of the range for commercial type IV phosphate ester hydraulic fluids. The results suggest that concentrations in the range of 5 to 10 micromole/100 gm of this erosion inhibitor might be at the lower end of the acceptable performance range defined by this test procedure.

What is claimed is:

1. A functional fluid composition comprising:

(a) a base stock comprising a phosphate ester, and (b) an effective erosion inhibiting amount of at least one erosion inhibitor selected from compounds represented by the formulas (I)

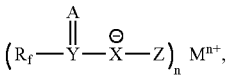

(II)

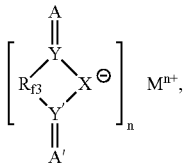

or mixtures thereof;

wherein said erosion inhibitor(s) used in said functional fluid composition at least partially ionize, and the effective amount of said erosion inhibitor(s) used in said functional fluid composition is essentially soluble in said functional fluid compositions;

wherein $R_f$ is selected from fluoroalkyl, fluoroaryl, fluoroaralkyl, fluoroalkaryl, fluorocycloalkyl, fluoroallcoxyalkyl, or fluoropolyalicoxyalkyl groups; Y and Y' are independently selected from C, S, S(═A), P—$R_f$, P—OR, or P—NRR'; A and A' are independently selected from O or NR; X is selected from N, or C—R"; Z is selected from Y'(═A')—$R_f$, H, OC(═O)—$R_f$, or $R_1$—NH—($SO_2$—Rf); R and R' are independently selected from H, alkyl, fluoroalkyl, aryl, fluoroaryl, alkaryl, aralkyl, fluoroalkaryl, or fluoroaralkyl; R" is selected from H, alkyl, fluoroalkyl, aryl, fluoroaryl, alkaryl, aralkyl, fluoroalkaryl, fluoroaralkyl, or —Y(═A)—$R_2$; $R_2$ is selected from alkyl, fluoroalkyl, aryl, fluoroaryl, alkaryl, aralkyl, fluoroalkaryl, or fluoroaralkyl; $R_1$ is selected from unsubstituted or fluoro-substituted alkylene, cycloalkylene, alkarylene, aralkylene, or arylene groups; $R_{f3}$ is selected from fluoroalkylene, fluoroarylene, fluoroaralkylene, fluoroalkarylene, fluoroalkoxyalkylene, or fluoropolyalkoxyalkylene moieties; M is a cation of valence n; and n is 1, 2, 3 or 4;

with the proviso that when both of Y and Y' are S(═A), X is N, A is O and n is less than 2 then only one $R_f$ is fluoroalkyl, fluoroalkaryl, fluorocycloalkyl, fluoroalicoxyalkyl, or fluoropolyalicoxyalkyl in Formula I.

2. The composition of claim 1 wherein said at least one erosion inhibitor is selected from compounds represented by the formula (I).

3. The composition of claim 2 wherein X is N.

4. The composition of claim 3 wherein Y is selected from C or S═A.

5. The composition of claim 4 wherein the anion of said at least one erosion inhibitor is selected from anions represented by the formulas:

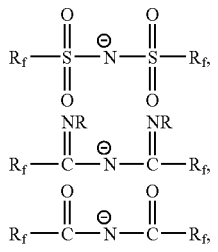

-continued

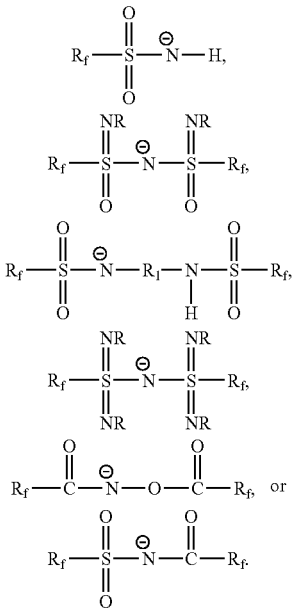

6. The composition of claim 5 wherein each $R_f$ is independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroallcoxyalkyl having 3 to about 21 carbon atoms, or perfinoropolyalkoxyalkyl having 3 to about 44 carbon atoms.

7. The composition of claim 3 wherein Y is S.

8. The composition of claim 3 wherein at least one Y group is selected from P—$R_f$, P—OR, or P—NRR'.

9. The composition of claim 8 wherein the anion of said at least one erosion inhibitor is selected from anions represented by the formulas:

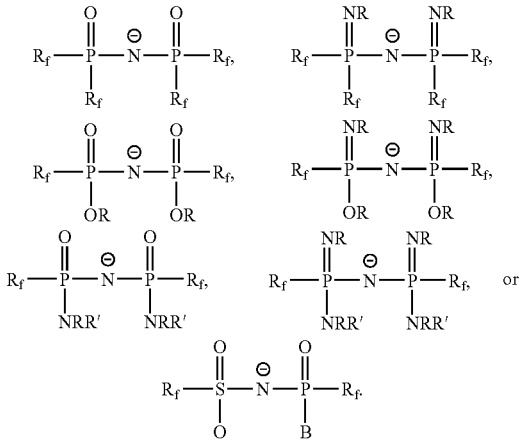

wherein B is OR or NRR'.

10. The composition of claim 9 wherein each $R_f$ is independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

11. The composition of claim 2 wherein X is C—R".

12. The composition of claim 11 wherein Y is selected from C or S═A.

13. The composition of claim 12 wherein the anion of said at least one erosion inhibitor is selected from anions represented by the formulas:

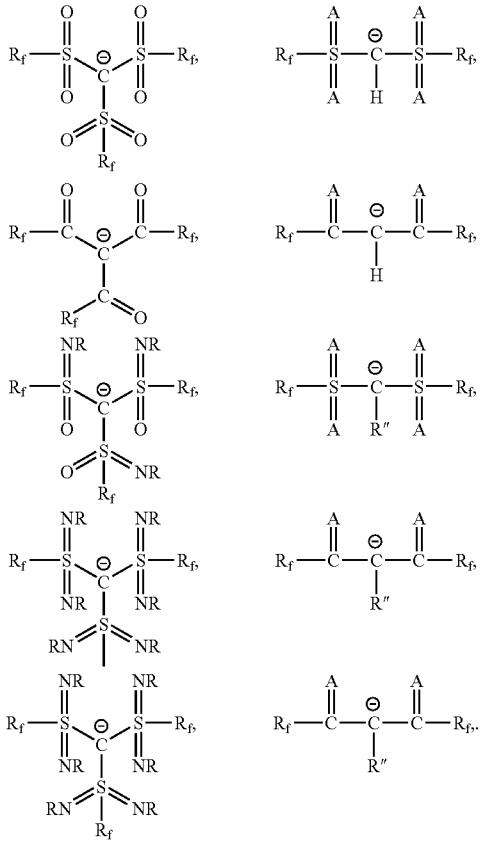

14. The composition of claim 13 wherein each $R_f$ is independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

15. The composition of claim 11 wherein Y is S.

16. The composition of claim 15 wherein the anion of said at least one erosion inhibitor is selected from anions represented by the formulas:

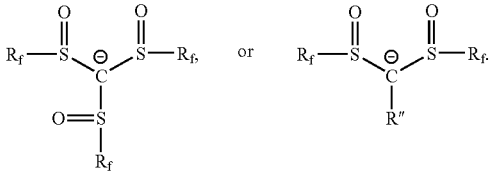

17. The composition of claim 16 wherein each $R_f$ is independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

18. The composition of claim 11 wherein at least one Y group is selected from P—$R_f$, P—OR, or P—NRR'.

19. The composition of claim 18 wherein the anion of said at least one erosion inhibitor is selected from anions represented by the formulas:

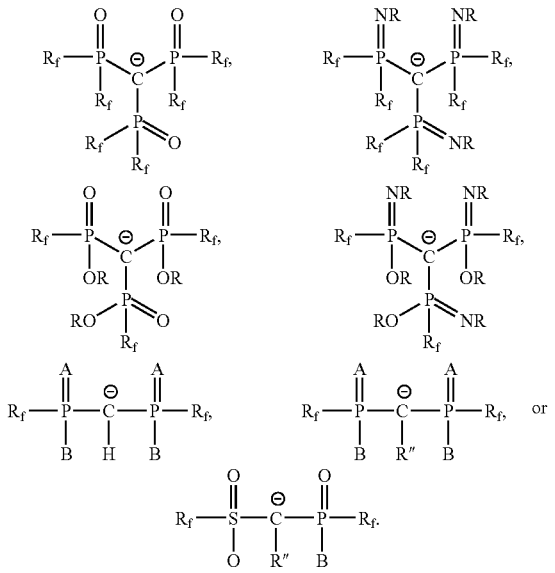

wherein B is OR or NRR'.

20. The composition of claim 19 wherein each $R_f$ is independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

21. The composition of claim 1 wherein said at least one erosion inhibitor is selected from compounds represented by the formula (II).

22. The composition of claim 21 wherein X is N.

23. The composition of claim 22 wherein Y is selected from C or S═A.

24. The composition of claim 23 wherein the anion of said at least one erosion inhibitor is selected from anions represented by the formulas:

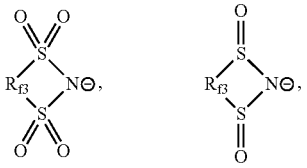

-continued

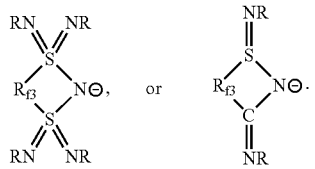

25. The composition of claim 24 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropolyalkoxyalkylene having 4 to about 30 carbon atoms.

26. The composition of claim 22 wherein Y is S.

27. The composition of claim 26 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropolyalkoxyalkylene having 4 to about 30 carbon atoms.

28. The composition of claim 22 wherein at least one Y group is selected from P—$R_f$, P—OR, or P—NRR'.

29. The composition of claim 28 wherein the anion of said at least one erosion inhibitor is selected from anions represented by the formulas:

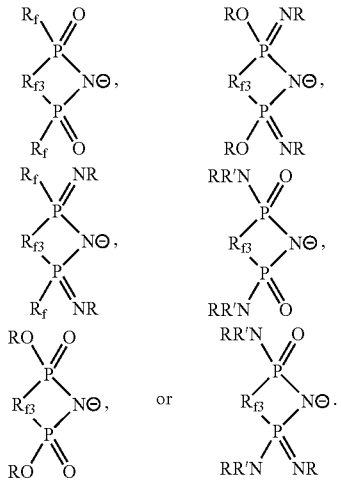

30. The composition of claim 29 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropolyalkoxyalkylene having 4 to about 30 carbon atoms.

31. The composition of claim 21 wherein X is C—R".

32. The composition of claim 31 wherein Y is selected from C or S═A.

33. The composition of claim 32 wherein the anion of said at least one erosion inhibitor is selected from anions represented by the formulas:

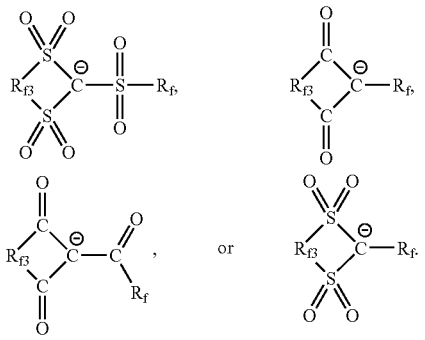

34. The composition of claim 33 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropolyalkoxyalkylene having 4 to about 30 carbon atoms.

35. The composition of claim 28 wherein Y is S.

36. The composition of claim 35 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropolyalkoxyalkylene having 4 to about 30 carbon atoms.

37. The composition of claim 31 wherein at least one Y group is selected from P—$R_f$, P—OR, or P—NRR'.

38. The composition of claim 37 wherein the anion of said at least one erosion inhibitor is selected from anions represented by the formulas:

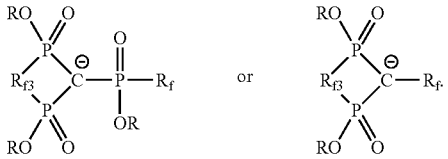

39. The composition of claim 38 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropotyalkoxyalkylene having 4 to about 30 carbon atoms.

40. The composition of claim 1 wherein the amount of said erosion inhibitor in said composition is at least 1 micromole erosion inhibitor per 100 g total fluid.

41. The composition of claim 40 wherein the amount of said erosion inhibitor in said composition is about 10 to about 200 micromole erosion inhibitor per 100 g total fluid.

42. The composition of claim 1 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

43. The composition of claim 42 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

44. The composition of claim 43 wherein M is selected from lithium, sodium, potassium, cesium, magnesium, calcium, lanthanum, cerium, aluminum, zinc, tetrasubstituted ammonium cations, tetrasubstituted phosphoniurn cations, or alkyl substituted imidazolium cations; wherein the tetrasubstituted ammonium and phosphonium cations are independently substituted with groups selected from alkyl groups having 1 to about 24 carbon atoms, aryl groups having 6 to 10 carbon atoms, aralkyl groups having 7 to about 34 carbon atoms, or alkaryl groups having 7 to about 34 carbon atoms; wherein the total number of carbon atoms in the tetrasubstituted ammonium and phosphonium cations is 4 to about 38, and wherein alkyl substituted imidazolium cations are substituted with two to five alkyl groups, wherein each alkyl substituent is independently 1 to 22 carbon atoms, the total number of carbon atoms in the alkyl substituted imidazolium cations is 5 to about 31, and one alkyl group is attached to each nitrogen atom of the imidazolium ring.

45. The composition of claim 44 wherein M is selected from lithium, potassium, calcium, lanthanum, magnesium, aluminum, zinc, tetraalkyl substituted ammonium or tetrasubstituted phosphonium; wherein the alkyl groups are independently selected from alkyl groups having 1 to about 24 carbon atoms, and the total number of carbon atoms in the tetrasubstituted ammonium and phosphonium cations is 5 to about 21.

46. The composition of claim 1 wherein when R" is —Y(═A)—$R_2$, —Y(═A)—$R_2$ is selected from —C(O)$R_2$ or —$SO_2$—$R_2$.

47. A functional fluid composition comprising:

(a) a basestock comprising a phosphate ester, and (b) an effective erosion inhibiting amount of at least one erosion inhibitor selected from compounds represented by the formulas $$[(R_{f1}SO_2)(R_{f2}SO_2)N]^-_n\ M^{n+}; \quad \text{(i)}$$

$$[(R_{f1}CO)(R_{f2}CO)N]^-_n\ M^{n+}; \quad \text{(ii)}$$

$$[(R_{f1}CO)(R_{f2}CO)C(R)]^-_n\ M^{n+}; \quad \text{(iii)}$$

$$[(R_{f1}SO_2)NH]^-_n\ M^{n+}; \quad \text{(iv)}$$

$$[(R_{f1}CO)(R_{f2}COO)N]^-_n\ M^{n+}; \quad \text{(v)}$$

$$[(R_{f1}SO_2)\text{-}N\text{-}R_1\text{-}NH\text{-}(R_{f2}SO_2)]^-_n\ M^{n+}; \quad \text{(vi)}$$

(vii)

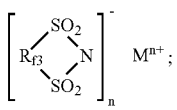

or mixtures thereof;

wherein $R_{f1}$ and $R_{f2}$ are independently selected from fluoroalkyl, fluoroaralkyl, fluoroalkaryl, fluorocycloalkyl, fluoroaryl, fluoroalkoxyalkyl, or fluoropolyalkoxyalkyl groups; M is a cation of valence n; n is 1, 2, 3 or 4; R is selected from H, alkyl, fluoroalkyl, aryl, fluoroaryl, alkaryl, fluoroalkaryl, aralkyl, or fluoroaralkyl;

$R_1$ is selected from unsubstituted or fluoro-substituted alkylene, cycloalkylene, alkarylene, aralkylene, or arylene groups; and $R_{f3}$ is selected from fluoroalkylene, fluoroarylene, fluoroaralkylene, fluoroalkarylene, fluoroalkoxyalkylene, or fluoropolyalkoxyalkylene moieties; and wherein said erosion inhibitor at least partially ionizes in said functional fluid, and said effective amount of said erosion inhibitor is essentially soluble in said functional fluid;

with the proviso that in Formula (i), when n is 2, only one of $R_{f1}$ and $R_{f2}$ is selected from the group consisting of fluoroalkyl, fluoroalkaryl, fluorocycloalkyl, fluoroallcoxyalkyl, or fluoropolyallcoxyalkyl and with the further proviso that in Formula (iv), when n is 2 then $R_{f1}$ is not selected from the group consisting of fluoroalkyl, fluoroalkaryl, fluorocycloalkyl, fluoroalkoxyalkyl, or fluoropolyalkoxyalky.

48. The composition of claim 47 wherein said erosion inhibitor comprises $$[(R_{f1}SO_2)(R_{f2}SO_2)N]^-_nM^{n+}.$$

49. The composition of claim 48 wherein $R_{f1}$ and $R_{f2}$ are independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

50. The composition of claim 49 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

51. The composition of claim 50 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

52. The composition of claim 51 wherein M is selected from alkali metal, tetraalkylammonium, tetraalkylphosphonium, alkyl substituted imidazolium, magnesium, calcium, aluminum, zinc, lanthanum, or cerium.

53. The composition of claim 52 wherein M is alkali metal, tetrabutylammonium, magnesium, calcium, lanthanum, or cerium; and $R_{f1}$ and $R_{f2}$ are independently selected from perfluoroalkyl having 1 to about 12 carbon atoms.

54. The composition of claim 47 wherein said erosion inhibitor comprises $$[(R_{f1}CO)(R_{f2}CO)N]^-_nM^{n+}.$$

55. The composition of claim 54 wherein $R_{f1}$ and $R_{f2}$ are independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

56. The composition of claim 55 wherein M is selected from inorganic cations selected from alkali metal, alkaline earth metal, Group IIIA metal, Group IIIB metal, Group IVA metal, Group VA metal, Group VIA metal, Group VIJA metal, Group VIIIA metal, Group IB metal, Zn or B, or organic cations selected from alkyl, aryl, alkaiyl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

57. The composition of claim 56 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

58. The composition of claim 57 wherein M is alkali metal, tetraalkylammonium, tetraalkylphosphonium, alkyl substituted imidazolium, magnesium, calcium, aluminum, zinc, lanthanum, or cerium.

59. The composition of claim 58 wherein M is lithium, tetrabutylammonium, magnesium, calcium, lanthanum, or cerium; and $R_{f1}$ and $R_{f2}$ are independently selected from perfluoroalkyl having 1 to about 12 carbon atoms.

60. The composition of claim 47 wherein said erosion inhibitor comprises $$[(R_{f1}CO)(R_{f2}CO)C(R)]^-_nM^{n+}.$$

61. The composition of claim 60 wherein $R_{f1}$ and $R_{f2}$ are independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

62. The composition of claim 61 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

63. The composition of claim 62 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

64. The composition of claim 63 wherein M is lithium, tetraalkylammonium, tetraalkylphosphonium, alkyl substituted imidazolium, magnesium, calcium, aluminum, zinc, lanthanum, or cerium; R is H, alkyl having 1 to about 22 carbon atoms, or fluoroalkyl having 1 to about 24 carbon atoms; and $R_{f1}$ and $R_{f2}$ are independently selected from perfluoroalkyl having 1 to about 12 carbon atoms.

65. The composition of claim 64 wherein M is lithium, tetrabutylammonium, magnesium, calcium, lanthanum, or cerium.

66. The composition of claim 47 wherein said erosion inhibitor comprises $$[(R_{f1}SO_2)NH]^-_nM^{n+}.$$

67. The composition of claim 66 wherein $R_{f1}$ is selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

68. The composition of claim 67 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

69. The composition of claim 68 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

70. The composition of claim 69 wherein M is alkali metal, tetraalkylammonium, tetraalkylphosphonium, alkyl substituted imidazolium, magnesium, calcium, aluminum, zinc, lanthanum, or cerium.

71. The composition of claim 70 wherein M is alkali metal, tetrabutylammonium, magnesium, calcium, lanthanum, or cerium; and $R_{f1}$ is perfluoroalkyl having 1 to about 12 carbon atoms.

72. The composition of claim 47 wherein said erosion inhibitor comprises $$[(R_{f1}CO)(R_{f2}COO)N]^-_nM^{n+}.$$

73. The composition of claim 72 wherein $R_{f1}$ and $R_{f2}$ are independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

74. The composition of claim 73 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

75. The composition of claim 74 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

76. The composition of claim 75 wherein M is lithium, tetraalkylammonium, tetraalkylphosphonium, alkyl substituted imidazolium, magnesium, calcium, aluminum, zinc, lanthanum, or cerium.

77. The composition of claim 75 wherein M is lithium, tetrabutylammonium, magnesium, calcium, lanthanum, or cerium; and $R_{f1}$ and $R_{f2}$ are independently selected from perfluoroalkyl having 1 to about 12 carbon atoms.

78. The composition of claim 47 wherein said erosion inhibitor comprises $$[(R_{f1}SO_2)—N—R_1—NH—(R_{f2}SO_2)]^-_nM^{n+}.$$

79. The composition of claim 78 wherein $R_{f1}$ and $R_{f2}$ are independently selected from perfluoroalkyl having 1 to about 24 carbon atoms, perfluorocycloalkyl having 4 to about 7 carbon atoms, perfluoroaryl having 6 to 10 carbon atoms, perfluoroaralkyl having 7 to about 34 carbon atoms, perfluoroalkaryl having 7 to about 34 carbon atoms, perfluoroalkoxyalkyl having 3 to about 21 carbon atoms, or perfluoropolyalkoxyalkyl having 3 to about 44 carbon atoms.

80. The composition of claim 79 wherein $R_1$ is unsubstituted or fluoro-substituted alkylene having 1 to about 8 carbon atoms, cycloalkylene having 4 to about 7 carbon atoms, arylene having 6 to 10 carbon atoms, alkarylene having 7 to about 18 carbon atoms, or aralkylene having 7 to about 18 carbon atoms.

81. The composition of claim 80 wherein $R_1$ is selected such that the sulfonamide groups are separated by 2 or 3 carbon atoms.

82. The composition of claim 81 wherein $R_1$ is cycloalkylene.

83. The composition of claim 82 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

84. The composition of claim 83 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

85. The composition of claim 84 wherein M is alkali metal, tetraalkylammonium, tetraalkylphosphonium, alkyl substituted imidazolium, magnesium, calcium, aluminum, zinc, lanthanum, or cerium.

86. The composition of claim 85 wherein M is alkali metal, tetrabutylammonium, magnesium, calcium, lanthanum, or cerium; and $R_{f1}$ and $R_{f2}$ are independently selected from perfluoroalkyl having 1 to about 12 carbon atoms.

87. The composition of claim 47 wherein said erosion inhibitor comprises

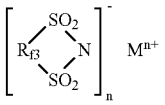

88. The composition of claim 87 wherein $R_{f3}$ is selected from fluoroalkylene having 2 to about 6 carbon atoms, fluoroarylene having 6 to 10 carbon atoms, fluoroaralkylene having 8 to about 16 carbon atoms, fluoroalkarylene having 8 to about 16 carbon atoms, fluoroalkoxyalkylene having 4 to about 12 carbon atoms, or fluoropolyalkoxyalkylene having 4 to about 30 carbon atoms.

89. The composition of claim 88 wherein $R_{f3}$ is selected from perfluoroalkylene having 2 to about 6 carbon atoms, perfluoroalkoxyalkylene having 4 to 6 carbon atoms, or perfluoropolyalkoxyalkylene having 4 to 6 carbon atoms.

90. The composition of claim 89 wherein M is selected from inorganic cations selected from alkali metal, alkaline earth metal, Group IIIA metal, Group IIIB metal, Group IVA metal, Group VA metal, Group VIA metal, Group VIIA metal, Group VIIIA metal, Group IB metal, Zn or B, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

91. The composition of claim 90 wherein M is selected from inorganic cations selected from alkali metal, alkaline earth metal, Group IIIA metal, Group IIIB metal, or zinc, or organic cations selected from alkyl, aryl, alkaryl, aralkyl, or mixed alkyl/aryl/alkaryl/aralkyl tetrasubstituted ammonium, alkyl, aryl, alkaryl, aralkyl, or mixed alkyl/aryl/alkaryl/aralkyl tetrasubstituted phosphonium, or alkyl substituted imidazolium.

92. The composition of claim 91 wherein M is alkali metal, tetraalkylammonium, tetraalkylphosphonium, alkyl substituted imidazolium, magnesium, calcium, aluminum, zinc, lanthanum, or cerium.

93. The composition of claim 92 wherein M is alkali metal, tetrabutylammonium, magnesium, calcium, lanthanum, or cerium; and $R_{f3}$ is perfluoroalkylene having 2 to about 6 carbon atoms.

94. The composition of claim 47 wherein the amount of said erosion inhibitor in said composition is at least 1 micromole erosion inhibitor per 100 g total fluid.

95. The composition of claim 94 wherein the amount of said erosion inhibitor in said composition is about 10 to about 200 micromole erosion inhibitor per 100 g total fluid.

96. The composition of claim 47 wherein said erosion inhibitor is selected from lithium, potassium, tetramethylammonium, tetrabutylammonium, tetramethylphosphonium, tetrabutylphosphonium, magnesium, calcium, or lanthanum bis(trifluoromethanesulfonyl)imidate lithium, potassium, tetramethylammonium, tetrabutylammonium, tetramethylphosphonium, tetrabutylphosphonium, magnesium, calcium, or lanthanum bis(nonafluorobutanesulfonyl) imidate lithium, potassium, tetramethylammonium, tetrabutylammonium, tetramethylphosphonium, tetrabutylphosphonium, magnesium, calcium, or lanthanum bis(perfluoroethoxyethylsulfonyl)imidate lithium, potassium, tetramethylammonium, tetrabutylammonium, tetramethylphosphonium, tetrabutylphosphonium, magnesium, calcium, or lanthanum bis(pentafiuoroethanesulfonyl)imidate lithium, tetramethylammonium, tetrabutylammonium, tetramethylphosphonium, tetrabutylphosphonium, magnesium, calcium, or lanthanum bis(trifluoroacet)imidate; lithium, tetramethylammonium, tetrabutylammonium, tetramethylphosphonium, tetrabutyiphosphonium or magnesium hexafluoroacetoacetonate; lithium, tetramethylammonium, tetrabutylammonium, tetramethylphosphonium, tetrabutylphosphonium, magnesium, calcium, or lanthanum trifluoromethanesulfonamidate; lithium, tetramethytammonium, tetrabutylammonium, tetramethylphosphonium, tetrabutylphosphonium, magnesium, calcium, or lanthanum salts of bis(trifluoroacetyl)hydroxylamine; lithium, tetramethylammonium, tetrabutylammonium, tetramethylphosphonium, tetrabutyiphosphonium, magnesium, calcium, or lanthanum trans-N,N'-1,2-cyclohexanediylbis(1,1,1-trifluoromethane-sulfonamidate) lithium, tetramethylammonium, tetrabutylammonium, tetramethylphosphonium, tetrabutylphosphonium, magnesium, calcium, or lanthanum cycic-1,3-perfluoropropanedisulfonimide; lithium, tetramethylammonium, tetrabutylammonium, tetramethyiphosphonium, tetrabutylphosphonium, magnesium, calcium, or lanthanum cyclic-1,2-perfluoroethanedisulfonimide; or mixtures thereof.

* * * * *

UNITED STATES PATENT AND TRADEMARK OFFICE

CERTIFICATE OF CORRECTION

PATENT NO. : 7,255,808 B2
APPLICATION NO. : 10/700395
DATED : August 14, 2007
INVENTOR(S) : David C. Silverman It is certified that error appears in the above-identified patent and that said Letters Patent is hereby corrected as shown below:

Claim 24, Col. 45, Line 62 – delete "S" in right hand formula and replace with -- C --
Claim 24, Col. 45, Line 65 – delete "S" in right hand formula and replace with -- C --
Claim 24, Col. 46, Line 4 – delete "S" in right hand formula and replace with -- C --

The correct formulas are as follows:

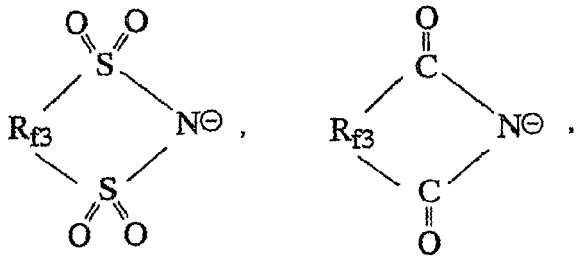

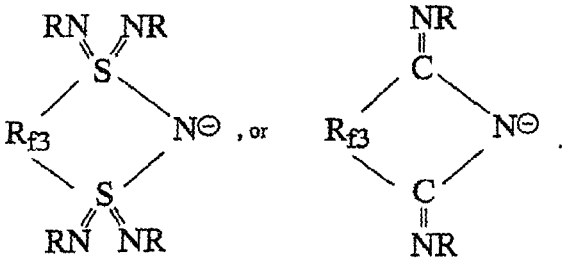

Signed and Sealed this

Twenty-sixth Day of August, 2008

JON W. DUDAS
*Director of the United States Patent and Trademark Office*